US012635781B2

(12) United States Patent
Briana et al.

(10) Patent No.: US 12,635,781 B2
(45) Date of Patent: May 26, 2026

(54) REUSABLE SOLID HYGIENE PRODUCT DISPENSER

(71) Applicant: BRIANA, LLC, Sierra Madre, CA (US)

(72) Inventors: Thomas William Briana, Altadena, CA (US); David Louis Worrell, Pasadena, CA (US); Niclas Henning Zieger, Passadena, CA (US)

(73) Assignee: BRIANA, LLC, Sierra Madre, CA (US)

( * ) Notice: Subject to any disclaimer, the term of this patent is extended or adjusted under 35 U.S.C. 154(b) by 176 days.

(21) Appl. No.: 18/301,771

(22) Filed: Apr. 17, 2023

(65) Prior Publication Data

US 2023/0248133 A1 Aug. 10, 2023

Related U.S. Application Data

(63) Continuation-in-part of application No. 17/879,315, filed on Aug. 2, 2022, now Pat. No. 11,684,137, which is a continuation of application No. 17/089,292, filed on Nov. 4, 2020, now Pat. No. 11,406,168.

(60) Provisional application No. 62/930,376, filed on Nov. 4, 2019.

(51) Int. Cl.
*A45D 40/02* (2006.01)
*A45D 40/00* (2006.01)

(52) U.S. Cl.
CPC ..... *A45D 40/02* (2013.01); *A45D 2040/005* (2013.01)

(58) Field of Classification Search
CPC ..... A45D 40/02; A45D 2040/005
USPC ..... 222/390, 391, 386; 401/65, 66, 83, 86, 401/87
See application file for complete search history.

(56) References Cited

U.S. PATENT DOCUMENTS 3,358,699 A * 12/1967 Bau ..... A45D 40/04 D28/7
4,506,810 A * 3/1985 Goncalves ..... B65D 83/0022 222/391
4,595,124 A 6/1986 Duval et al.
4,865,231 A 9/1989 Wiercinski
4,884,912 A 12/1989 Gueret
4,890,944 A 1/1990 Cousins et al.
(Continued)

FOREIGN PATENT DOCUMENTS

WO 2007/043092 4/2007

OTHER PUBLICATIONS

"Oblong." Merriam-Webster.com Dictionary, Merriam-Webster, https://www.merriam-webster.com/dictionary/oblong. Accessed Jul. 10, 2025. (Year: 2025).*

*Primary Examiner* — Paul R Durand
*Assistant Examiner* — Michael C Patterson
(74) *Attorney, Agent, or Firm* — Brooks Kushman P.C.

(57) ABSTRACT

A dispenser for a product including a handle, and a slider disposed inside the handle. A cartridge receives product and a carrier is adapted to retain the product. A carrier pusher connects with the carrier. An actuator connects between the slider and the carrier pusher and is configured to advance the carrier pusher, the carrier, and the product. The actuator includes a pusher fork that extends from the slider to the carrier pusher. The pusher fork has a first set of teeth that are connected to a second set of teeth provided on the carrier pusher.

12 Claims, 19 Drawing Sheets

(56) References Cited

U.S. PATENT DOCUMENTS 5,000,356 A 3/1991 Johnson et al.
5,011,317 A * 4/1991 Gueret ..... A45D 40/262 401/179
5,102,249 A 4/1992 Holloway et al.
5,320,259 A * 6/1994 Weinstein ..... A45D 40/02 222/391
5,399,040 A 3/1995 Holloway
5,833,382 A 11/1998 Jenks et al.
5,860,572 A * 1/1999 Harrold ..... B65D 83/0022 222/391
5,984,551 A 11/1999 Kinney, Jr.
5,984,553 A 11/1999 Piscopo et al.
6,003,736 A * 12/1999 Ljunggren ..... A61M 5/14566 222/386
6,210,061 B1 4/2001 Johnson
6,592,278 B1 7/2003 Holthaus
7,503,717 B2 * 3/2009 Gutberlet ..... A45D 40/205 401/179
7,748,980 B2 * 7/2010 Mulhauser ..... A61C 5/62 222/326
7,845,874 B2 12/2010 Crosnier et al.
8,342,764 B2 1/2013 Bonneyrat
8,540,124 B2 * 9/2013 Francavilla ..... A61M 5/31593 222/391
9,210,985 B2 12/2015 Arwatz et al.
9,891,217 B2 2/2018 Petruno et al.
10,278,473 B2 5/2019 Groffsky et al.
11,103,046 B2 * 8/2021 Ohba ..... B43K 24/02
11,266,789 B2 * 3/2022 Lefebvre ..... A61M 5/3137
11,406,168 B2 8/2022 Briana
2009/0214283 A1 8/2009 Thiebaut
2011/0020048 A1 * 1/2011 Fukumoto ..... B43M 11/06 401/66
2012/0155947 A1 * 6/2012 Toh ..... A45D 34/041 206/524.1
2012/0184917 A1 * 7/2012 Bom ..... A61M 5/3157 604/187

* cited by examiner

REUSABLE SOLID HYGIENE PRODUCT DISPENSER

CROSS-REFERENCE TO RELATED APPLICATIONS

This application is a continuation-in-part of U.S. application Ser. No. 17/879,315 filed Aug. 2, 2022, now U.S. Pat. No. 11,684,137 issued Jun. 27, 2023, which is a continuation of U.S. application Ser. No. 17/089,292 filed Nov. 4, 2020, now U.S. Pat. No. 11,406,168 issued Aug. 9, 2022, which claims the benefit of U.S. provisional application Ser. No. 62/930,376 filed Nov. 4, 2019, the disclosures of which are hereby incorporated in their entirety by reference herein.

TECHNICAL FIELD

This disclosure relates to a dispenser for solid or semi-solid products.

BACKGROUND

Items such as lipstick and deodorant are often dispensed in a tube or similar dispenser with a product advancing mechanism. One type of advancing mechanism is generally a screw thread including a male screw thread portion that is axially affixed but is rotatable relative to the outer package. A carrier portion is axially movable relative to the outer package but rotatably fixed to the outer package and has a complementary female screw thread. As the male screw thread is turned, the female screw thread travels in the axial direction to advance or retract the product to be dispensed from the outer package. One problem with this design is that the entire package, often much or most of which is a form of plastic or other non-biodegradable material, is designed to be disposed of once the product is consumed. Another disadvantage is that the packaging is made of inexpensive materials reducing the overall aesthetics of the package.

The above type of dispenser does not allow for a quick advancement and retraction of the product. To advance or retract the product relative to the outer package, the threaded portion must be turned multiple times.

There is a need for a dispenser that is reusable and reduces the amount of disposable packaging material while providing a more aesthetically pleasing outer package.

There is also a need to provide an outer package that is adapted to receive a refill of the product to be dispensed that can be exchanged for another product quickly and easily.

SUMMARY

According to one aspect of this disclosure, a dispenser for a product is disclosed that comprises a handle, a slider disposed inside the handle, a cartridge defining a product receptacle, a carrier adapted to retain the product that is received in the product receptacle, and a carrier pusher connected to the carrier. An actuator is connected between the slider and the carrier pusher and is configured to advance the carrier pusher, the carrier, and the product. The actuator includes a pusher fork that extends from the slider to the carrier pusher. The pusher fork has a first set of teeth that are connected to a second set of teeth provided on the carrier pusher.

According to other aspects of this disclosure as it relates to a dispenser, additional features and alternatives are described below.

The handle may include a front handle portion and a rear handle portion that are assembled together to form the handle.

A return lock lever may be connected to a lever seat on the handle, the return lock lever including a lever tooth on a distal end, wherein the carrier pusher has a set of pusher teeth that are engaged by the lever tooth, and wherein when the slider is advanced the lever tooth is received in one of the pusher teeth to prevent retraction of the carrier pusher.

A spring may be supported by a spring retainer on the handle that extends between the spring retainer and the return lock lever. The spring exerts a biasing force on the return lock lever opposing the slider being advanced and locking the carrier pusher relative to the handle.

A first return lock lever and a second return lock lever are connected to a first lever seat and a second lever seat provided on the handle. Each return lock lever may include at least one lever tooth on a distal end. The carrier pusher may have first and second pluralities of pusher teeth that are each engaged by the at least one lever tooth so that when the slider is advanced, each lever tooth is received by one of the pusher teeth to prevent retraction of the carrier pusher.

A first spring may be supported by a first spring retainer on the handle that extends between the first spring retainer and the first return lock lever. The first spring exerts a first biasing force on the first return lock lever opposing the slider as it is advanced and locks the carrier pusher relative to the handle.

A second spring may be supported by a second spring retainer on the handle that extends between the second spring retainer and the second return lock lever. The second spring exerts a second biasing force on the second return lock lever opposing the slider as it is advanced and locks the carrier pusher relative to the handle.

A lid may be provided that has an end surface configured to support the dispenser and that defines a cavity. The product is partially received in the cavity defined by the lid and is partially received in the cartridge.

The handle includes a front portion, and a rear portion that extend in one direction and are parallel to each other. The lid has an end surface oriented at an acute angle relative to the one direction so that when the dispenser is supported on the end surface of the lid, the front portion and the rear portion of the handle are adapted to be disposed at the same acute angle relative to a supporting surface.

The dispenser further comprises a cartridge defining a receptacle for the product that is received by the handle to enclose the product. The cartridge may be replaced when the product is consumed with a second cartridge including a second replacement product.

The dispenser is partially recyclable because the handle, actuator, and lid are not replaced when the second cartridge including a replacement product is replaced.

According to another aspect of this disclosure, a dispenser system is disclosed that comprises a handle, a slider received within the handle, a cartridge assembled within the handle, the cartridge having a base wall defining an opening, and a product at least partially contained in the cartridge. A carrier is also disposed within the handle and a carrier pusher is connected to the carrier. An actuator is connected between the slider and the carrier pusher that advances the carrier pusher, the carrier, and the product.

According to other aspects of the dispenser system, additional features and alternatives are described below.

A pusher fork extends from the slider to the carrier pusher that may have a first set of teeth that are connected to a second set of teeth provided on the carrier pusher.

The actuator may have a compressed position and an expanded position and the slider may be engaged to move the actuator between the compressed position and the expanded position to advance the carrier and the product from the handle.

A lid may have an end surface that can support the dispenser and that defines a cavity in which the product is at least partially received and the product is partially received in the cartridge.

The handle may include a front portion, and a rear portion that extend in one direction and are parallel to each other. The end surface of the lid is oriented at an acute angle relative to the one direction, and when the dispenser is supported on the end surface of the lid, the front portion and the rear portion of the dispenser are adapted to be disposed at the same acute angle relative to a supporting surface.

A lid defining a cup shaped enclosure is received on the cartridge to enclose the product when the cartridge is replaced with a second cartridge including a replacement cartridge and a replacement product.

According to a further aspect of this disclosure, a solid product dispenser is disclosed that comprises a handle, a product cartridge received by the handle, a solid product received in the product cartridge, and a slider disposed within the handle. The slider engages the product cartridge, and the carrier pusher includes a lock that allows movement in an advancement direction to advance the product from the handle, and wherein the lock secures the carrier pusher in a selected position with a set of interlocking teeth relative to the handle after movement in the advancement direction.

BRIEF DESCRIPTION OF THE DRAWINGS

FIGS. 32A-34A are detailed views taken within the circled areas of FIGS. 32-34.

DETAILED DESCRIPTION

Detailed embodiments of the present invention are disclosed. The disclosed embodiments are merely examples of the invention that may be embodied in various and alternative forms. The figures are not necessarily to scale, and some features may be exaggerated or minimized to show details of particular components. The specific structural and functional details disclosed are not to be interpreted as limiting, but merely as a representative basis for teaching one skilled in the art to practice the present invention. The terms upward and downward as used herein refer to the orientation of the drawings in the figures and should not be construed to limit the orientation of the dispenser when in use which could be any orientation.

Referring generally to the Figures, a packaging system 10, or dispenser, is disclosed in which a consumable product 12 is contained and protected in a product cartridge 14 that is adapted to be received in a dispenser housing 16 by assembling the product cartridge 14 to the dispenser housing 16.

Figure 1:
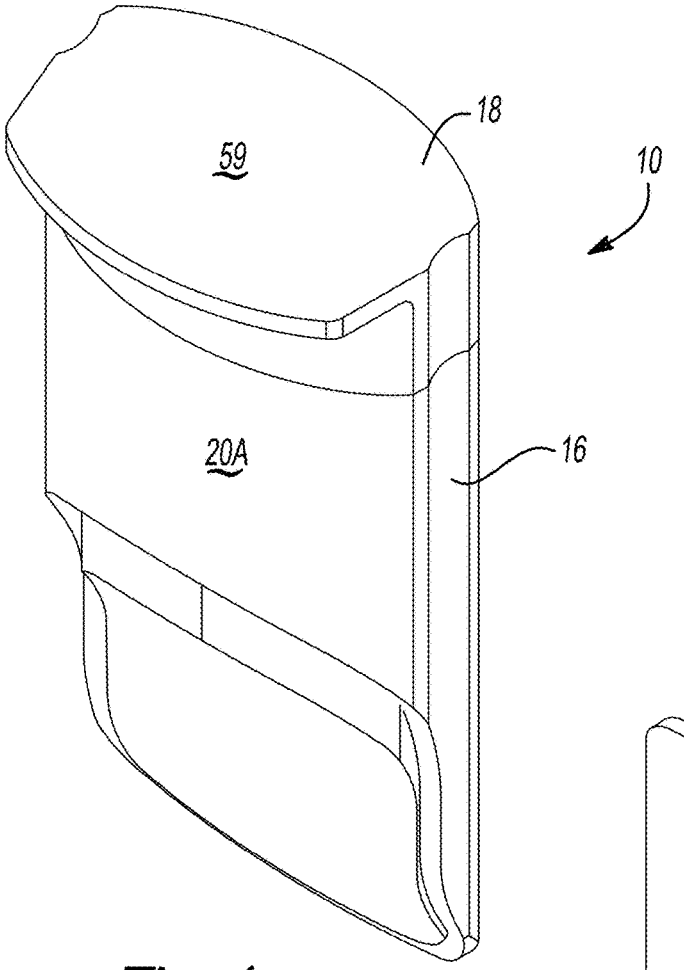
FIG. 1 is a perspective view of the assembled package in the loaded and capped configuration.
Figure 2:
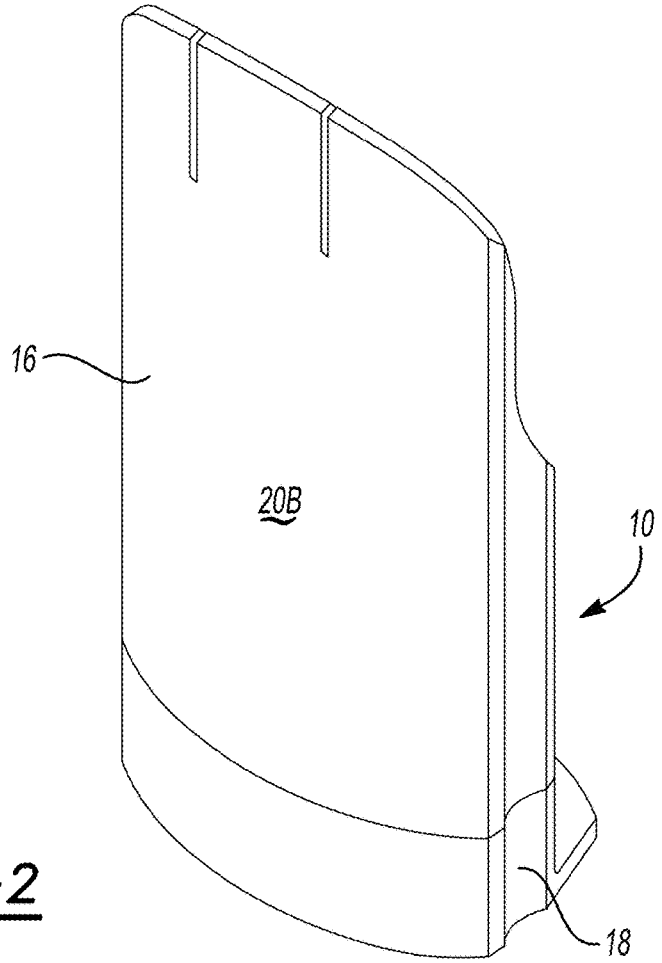
FIG. 2 is an opposite perspective view of FIG. 1 rotated 180° along an axis extending from top-left to bottom-right.
Figure 3A:
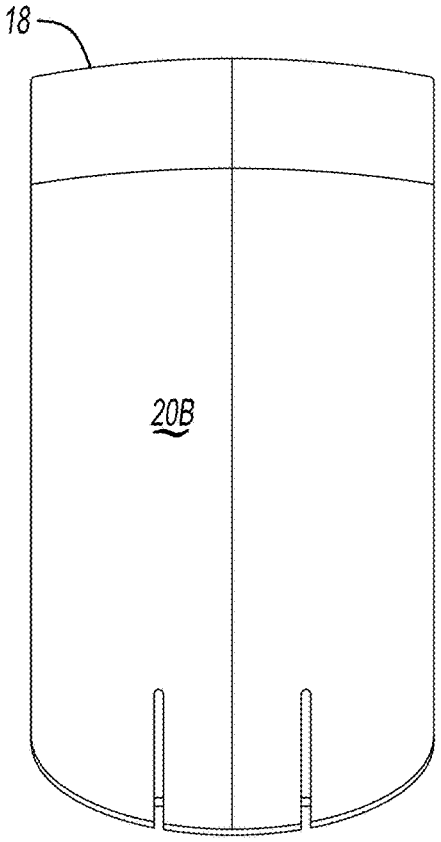
FIGS. 3A-3F are back, left side, front, right side elevation views, top and bottom plan views of the of the component parts of the package.
Figure 3B:
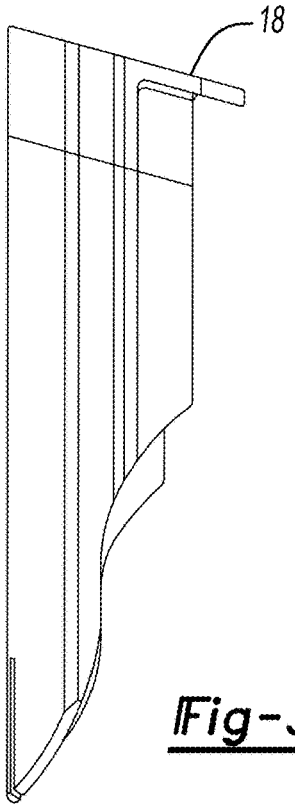
Figure 3C:
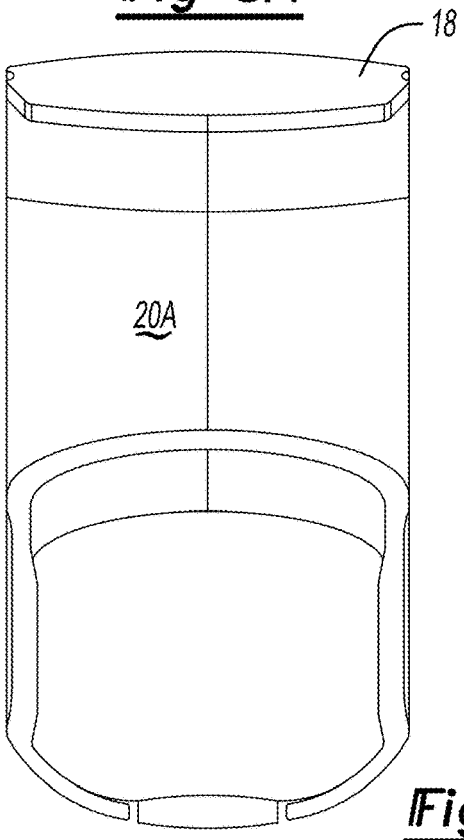
Figure 3D:
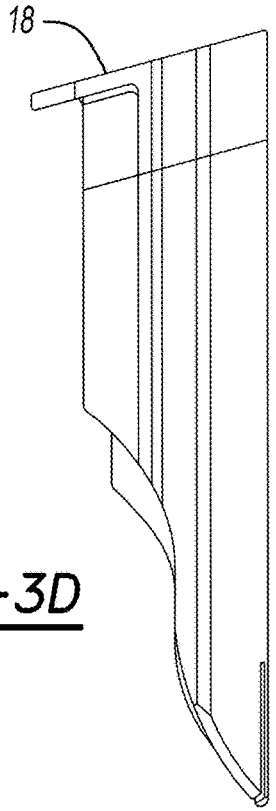
Figure 3E:
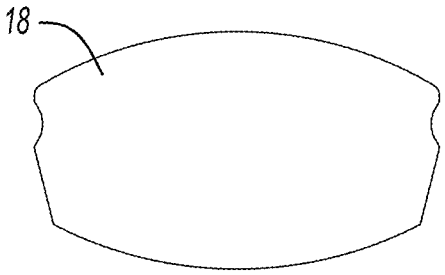
Figure 3F:
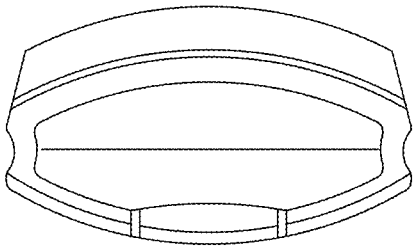

FIGS. 1-3 show an assembled package system 10 with a protective cap 18. The consumable product 12 is not visible in FIGS. 1-3 as it is protected on all sides by the dispenser housing 16 made of plastic or metal. The dispenser housing 16 protects the consumable product 12, and reduces the possibility of transferring the consumable product 12 to the hands or otherwise unintended transfer of the consumable product 12.

Figure 4:
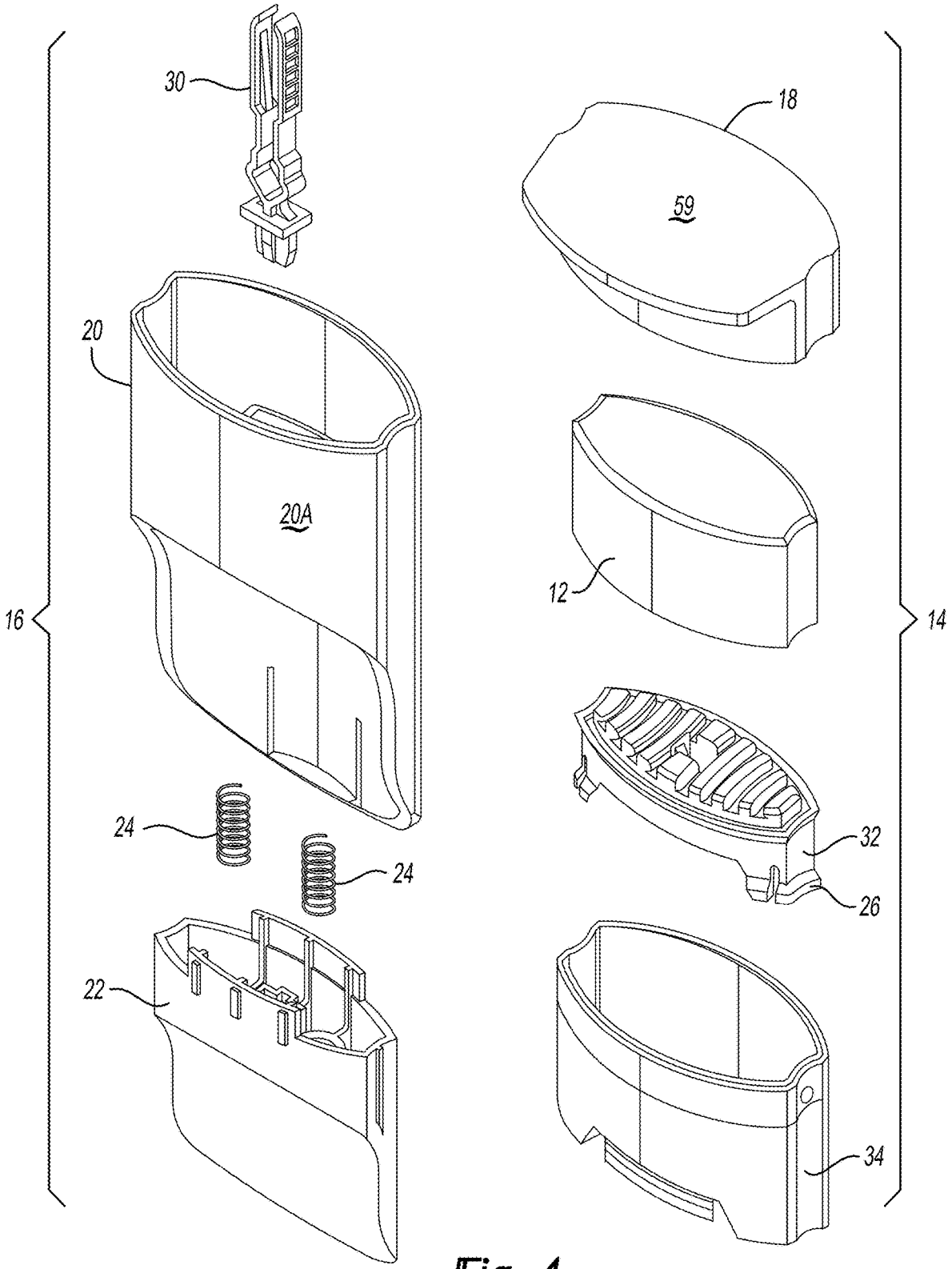
FIG. 4 is an exploded perspective view of the package of FIG. 1.
Figure 5:
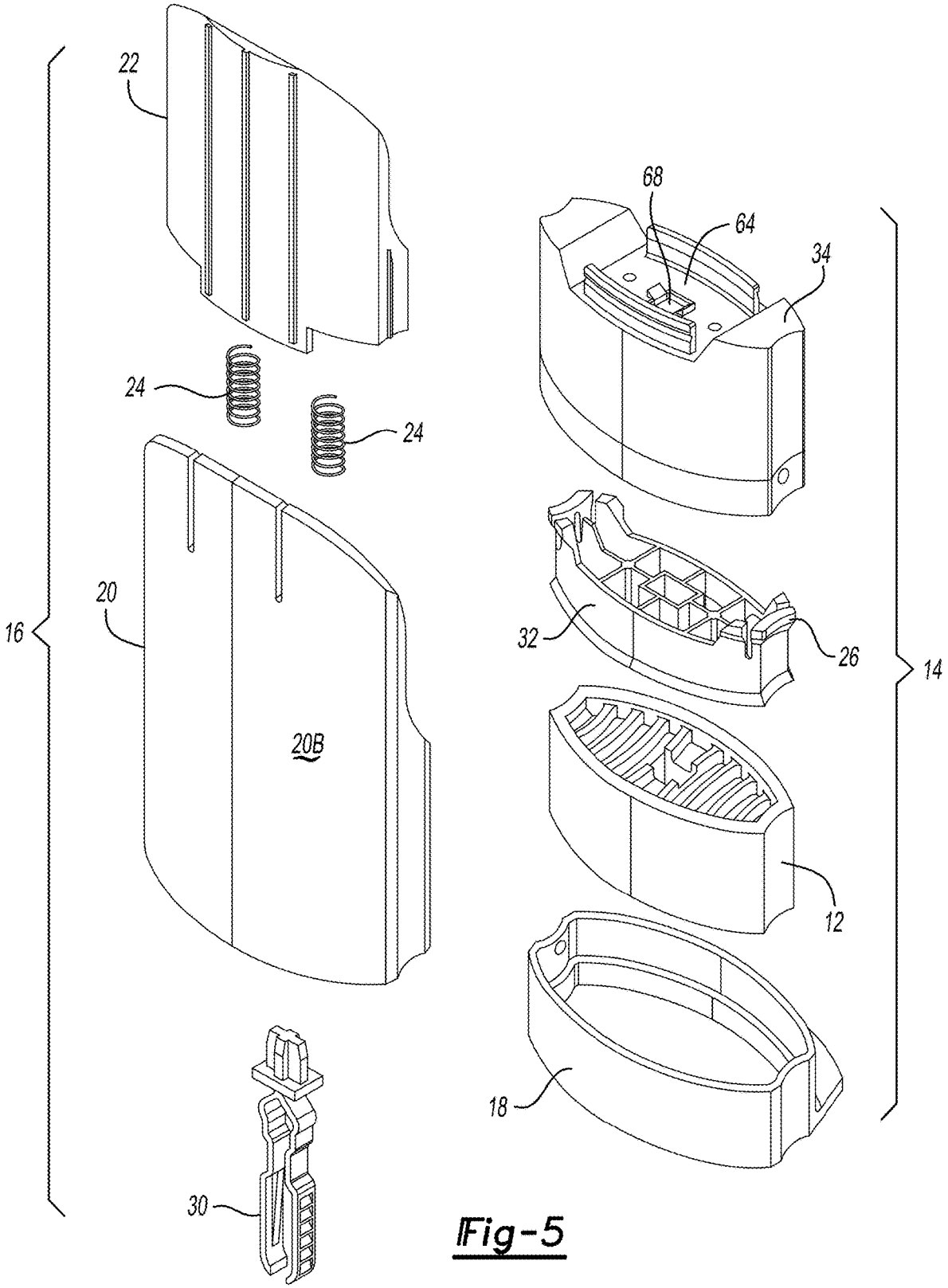
FIG. 5 is an inverted exploded perspective view of the package of FIG. 1.

FIGS. 4 and 5 show the complete packaging system 10 in an exploded prospective view. The dispenser housing 16 includes an outer shell 20 adapted to receive a slider 22 that is inserted into the outer shell 20. Helical compression springs 24 are disposed between the inner shell 34 and the slider 22 to bias the slider 22 away from the inner shell 34. The springs 24 can be of any number and made of any suitable material including steel, foam or air in a plastic bubble. A retaining latch 26 at the base of the carrier 32 retains the carrier 32 within the inner shell 34 during normal use. An extension and retraction actuator 30 (hereinafter the "actuator") is fixedly attached to the slider 22.

The product cartridge 14 includes the carrier 32 and is inserted into the inner shell 34. The inner shell 34 with carrier 32 is placed into the cap 18. The consumable product 12 (hereinafter the "product") is filled in a liquid or semi-liquid state through the central rectangular opening of the inner shell 34 and the carrier 32. The inner shell 34 is filled until the top surface of the product 12 comes into contact with the bottom surface of the carrier 32. The product 12 is allowed to cool to change to a solid or semi-solid state. An adhesive bond is created when the product 12 contacts the carrier 32. This is an efficient method of packaging the product 12 within the final package, eliminating the need for separate casting tooling and processes.

Figure 6:
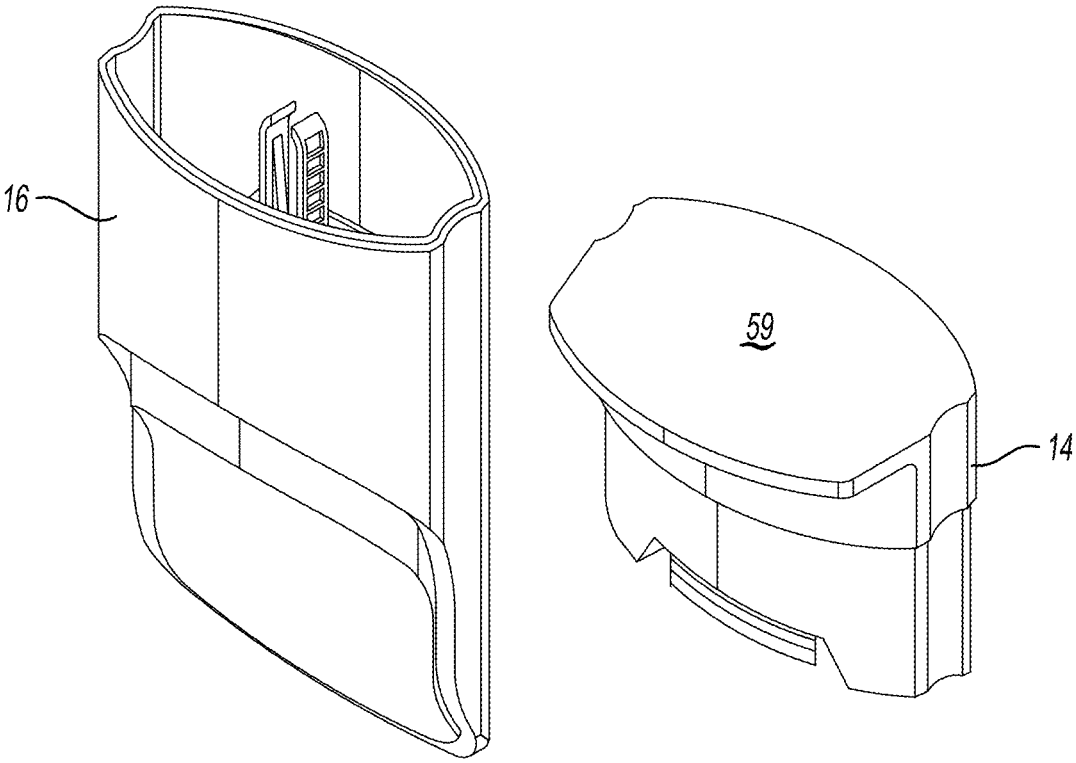
FIG. 6 is a perspective view of the dispenser housing and product cartridge without the product shown next to an assembled reloadable product cartridge and cap.
Figure 7:
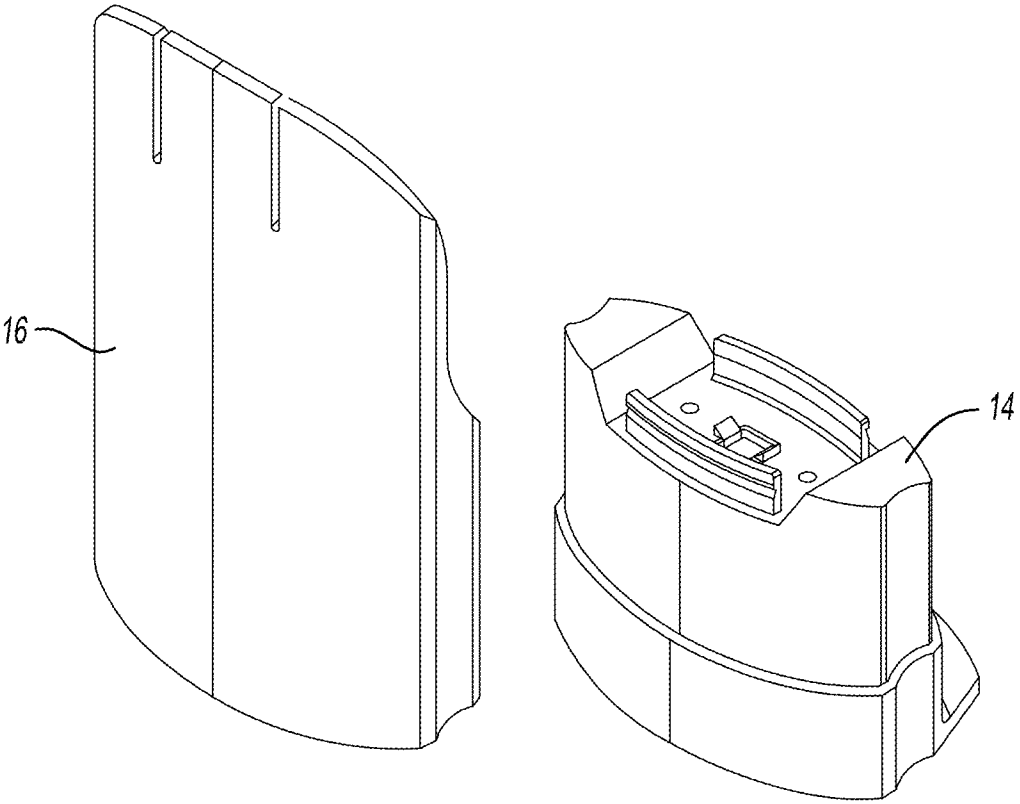
FIG. 7 is a reverse perspective view of the dispenser housing and product cartridge, and cap of FIG. 6.

FIGS. 6 and 7 show the completed dispenser housing 16 and product cartridge 14 assemblies. These assemblies can now be assembled to each other while remaining separable as described below.

FIGS. 8 through 13 show the product cartridge 14 being assembled to the dispenser housing 16 for initial use.

Figure 8:
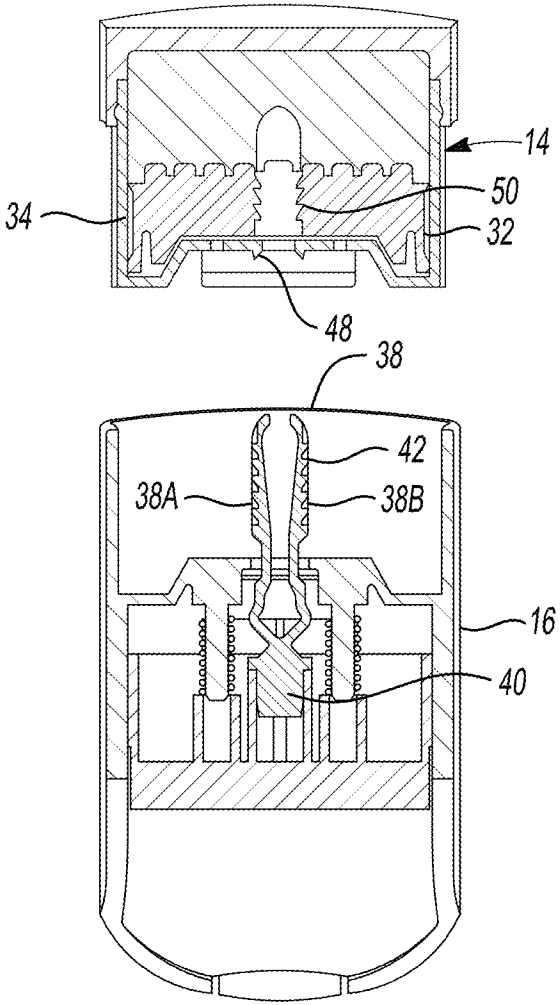
FIG. 8 is a central vertical plane/widthwise cross-section view of the housing without the dispensable product, a reloadable product cartridge, and cap aligned for loading the product cartridge into the housing.
Figure 11:
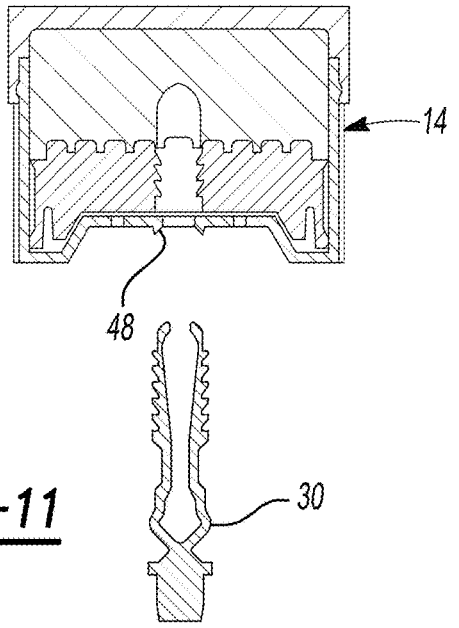
FIG. 11 is a central vertical plane/widthwise cross-section view of the product cartridge, and cap with the advancement and retraction actuator separated from the consumable product cartridge.
Figure 12:
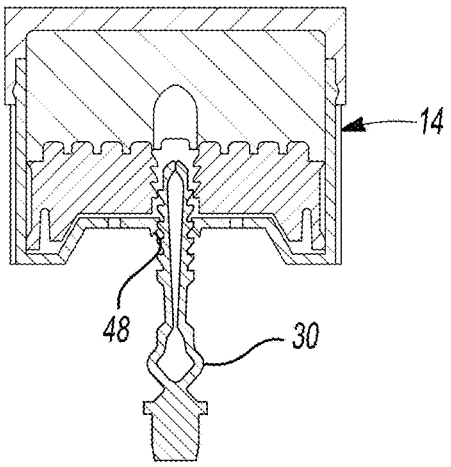
FIG. 12 is a central vertical plane/widthwise cross-section view of the product cartridge, and cap with the advancement and retraction actuator partially received in the consumable product cartridge.

FIGS. 8 and 11 show the product cartridge 14 in longitudinal axial alignment to the dispenser housing 16. The actuator 30 is in a relaxed state, or expanded position, shown in FIG. 36A through 38A. In the relaxed state, the actuator arms 38A and 38B are angled away from the vertical axis starting at the base 40 where the arms meet by ½°, 1°, 2° or an amount that compensates for the material elastic properties. The material may be plastic, metal, a composite of plastic and metal, or any other material or combination of materials exhibiting elastic deflection. The angled displacement of the arms 38A and 38B allows force to be applied between the arms 38A and 38B and the receiving elements of the carrier 32 as discussed below.

Figure 9:
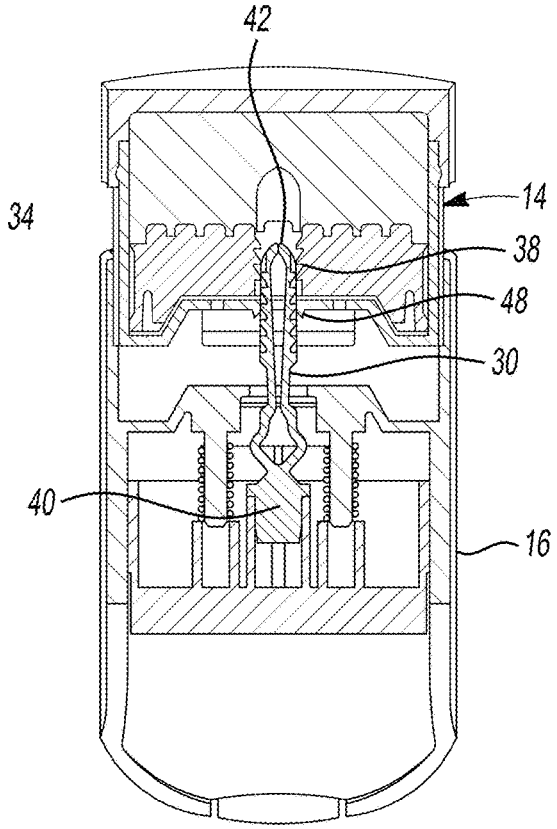
FIG. 9 is a central vertical plane/widthwise cross-section view of the housing product cartridge, and cap in an intermediate condition.
Figure 36B:
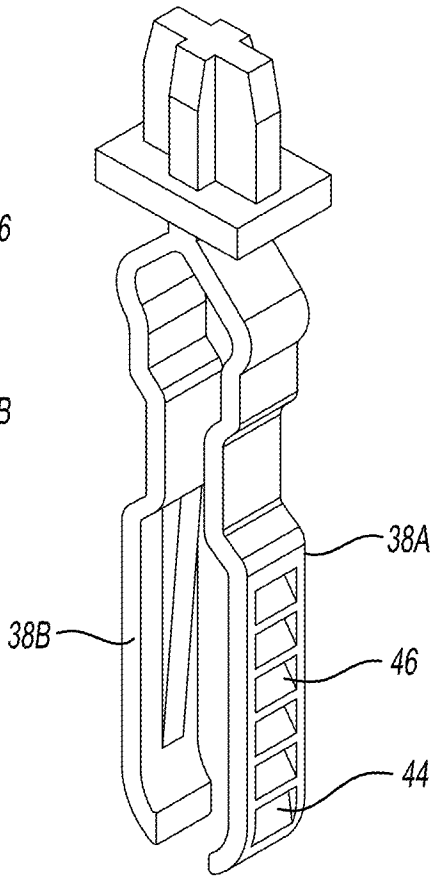
FIG. 36B is an opposite perspective view of FIG. 36A rotated 180° along an axis extending from top-left to bottom-right.
Figure 36A:
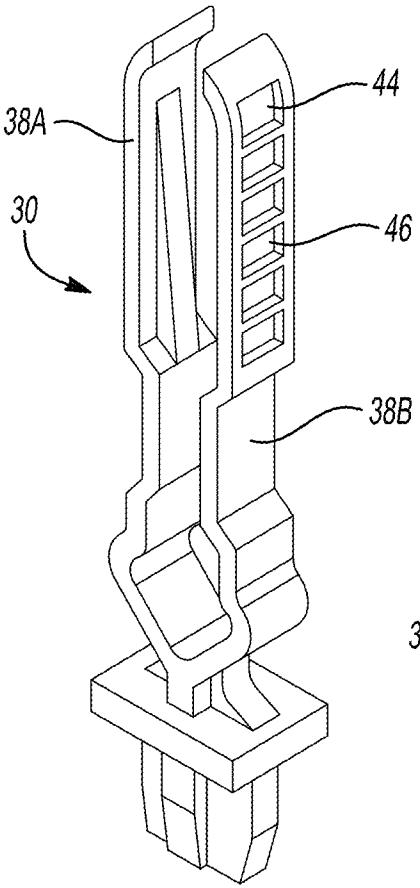
FIG. 36A is a perspective view of the advancement and retraction actuator.

FIG. 9 shows the product cartridge 14 assembled to the dispenser housing 16 in an intermediate position. The actuator arms 38A and 38B are shown to be displaced inwardly in FIG. 38B. The lateral distance, or width, of the shell opening 48 at the base of the inner shell 34 is less than the spacing of the widest portion of the actuator arms 38A and 38B. The inwardly facing tips 42 of the actuator 30 at the top end initiate the deflection of the arms 38. The actuator arms 38A and 38B have a rail portion 44 as shown in FIGS. 36A and 36B that act as a rail guiding the teeth 46 through the shell opening 48. Displacement of the teeth 46 of the actuator 30 clears the teeth 50 of the carrier 32.

The product cartridge 14 slides into the dispenser housing 16 without changing the position of the carrier 32 and product 12 in relation to the inner shell 34 and cap 18.

Figure 10:
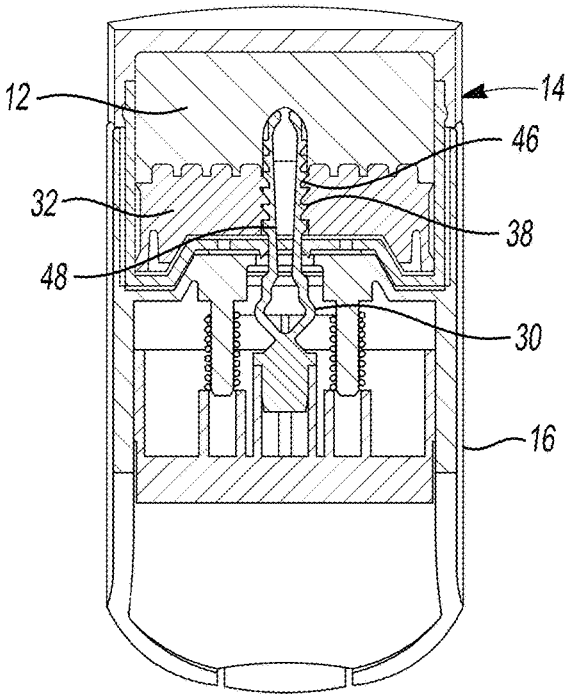
FIG. 10 is a central vertical plane/widthwise cross-section view of the housing product cartridge, and cap in a loaded condition.
Figure 13:
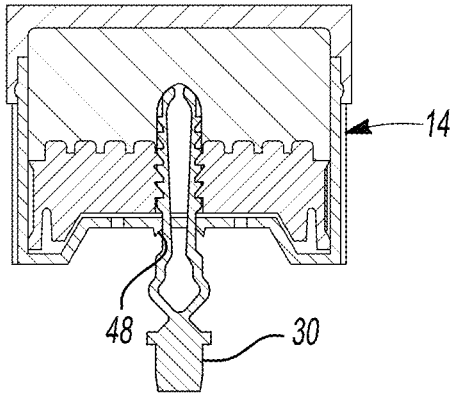
FIG. 13 is a central vertical plane/widthwise cross-section view of the product cartridge, and cap with the advancement and retraction actuator fully received in the consumable product cartridge.
Figure 38C:
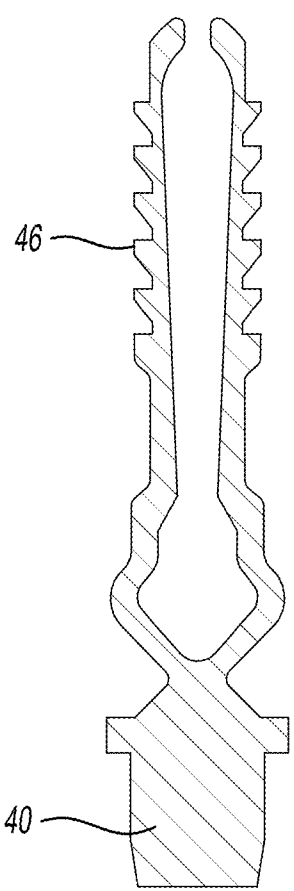
FIG. 38A-38C are a series of views of the advancement and retraction actuator different positions.

FIGS. 10 and 13 show the product cartridge 14 fully assembled to the dispenser housing 16. The drive arms 38A and 38B are in an engaging position as also shown in FIG. 38C. The lateral width of the shell opening 48 at the base of the inner shell 34 is equal to or greater than the width of the proximate portion of the drive arms 38A and 38B. The teeth 46 of the actuator 30 engage the teeth of the carrier 32 to advance the product 12.

Figure 32:
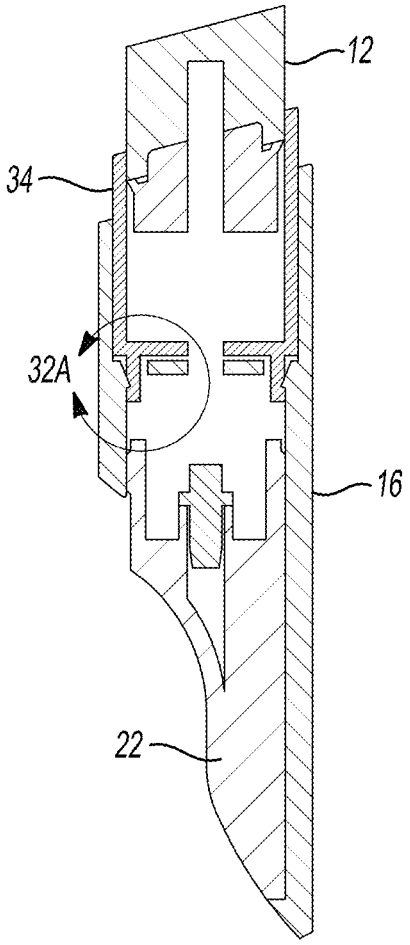
FIGS. 32-35 are central vertical plane/front to back views showing a progression of steps for removing the consumable product cartridge.
Figure 32A:
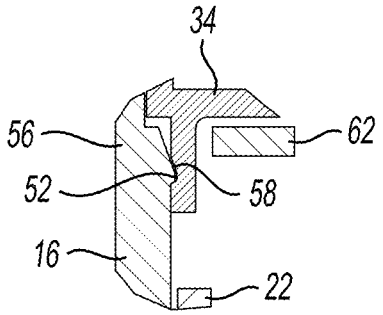

Referring to FIGS. 32 and 32A, the shell latch 52 at the base wall 62 of the inner shell 34 engages a complementary dispenser latch 56 on the dispenser housing 16. The shell latch 52 includes an angled ramp surface 58 of approximately 20° from vertical allows the shell latch 52 to slide past the dispenser latch 56. The angle may be in a range between 0° to 90° to accommodate the overall requirements of the system. Once latched, the product cartridge 14 is affixed to the inner shell 34 of the dispenser housing 16.

FIGS. 14 through 23 show the product 12 being advanced within the dispenser housing 16.

Figure 14:
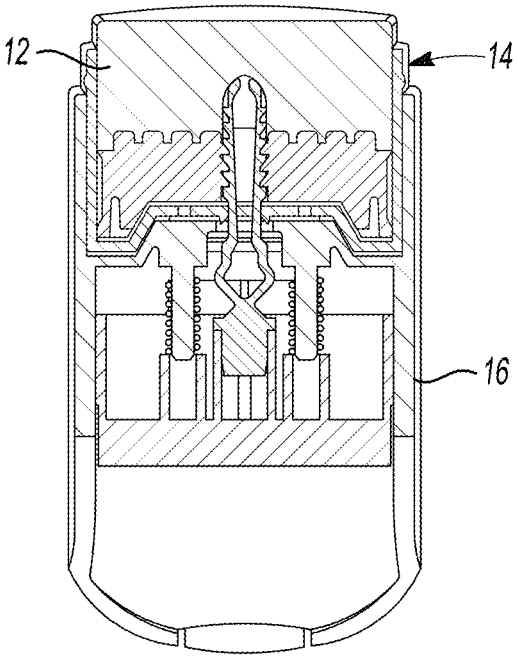
FIG. 14 is a central vertical plane/widthwise cross-section view of the outer package with an assembled reloadable product cartridge in a loaded condition with the protective cap removed.
Figure 19:
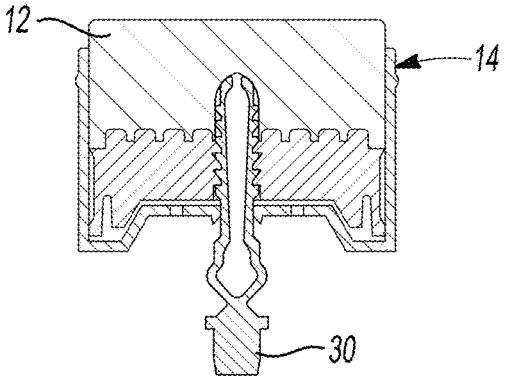
FIGS. 19-21 are central vertical plane/widthwise cross-section views of the advancement and retraction actuator fully received in the reloadable consumable product cartridge with the protective cap removed in several stages of advancement.

FIGS. 14 and 19 show the initial state of the product 12 for use, like FIG. 10, but with the protective cap 18 removed. With the cap 18 removed, a portion of the product 12 is exposed and may be placed in contact with a surface for application of the product 12. The exposed portion may also be cut off as a slice. During application or after slicing, the product 12 is consumed.

Figure 15:
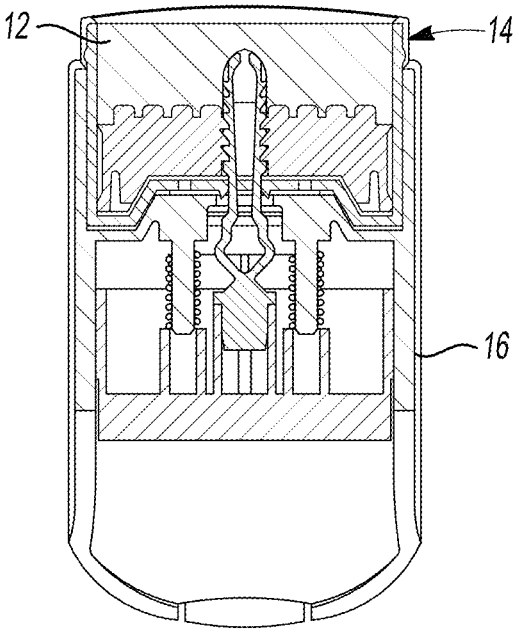
FIG. 15 is a central vertical plane/widthwise cross-section view of the outer package with an assembled reloadable product cartridge in a loaded condition with a portion of the product used.
Figure 20:
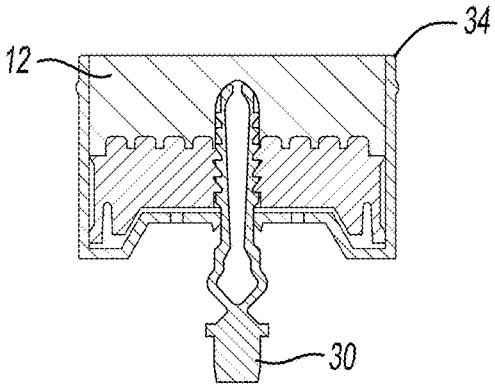

FIGS. 15 and 20 show the top exposed portion of the product 12 missing due to consumption. The top surface of the product 12 is now aligned with the top edge surface of the inner shell 34.

Figure 41:
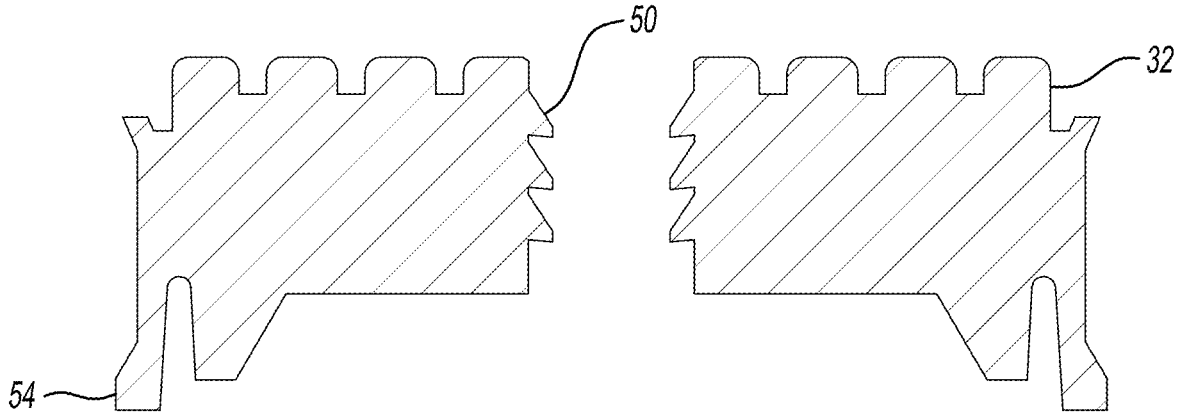
FIG. 41 is a central vertical plane/widthwise view of the carrier.
Figure 42:
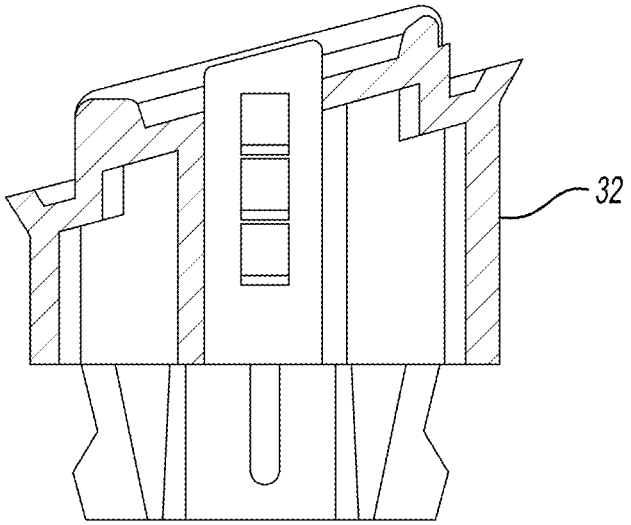
FIG. 42 is a central vertical plane/front to back view of the carrier.

Referring to FIGS. 38C and 41, the drive teeth 46 engage the carrier teeth 50. The drive teeth 46 of FIG. 38C are biased by the springs 24 in an upward direction while the mating teeth 50 of the carrier 32 shown in FIG. 41 are biased in the downward direction. FIGS. 10 through 31 show the teeth 46, 50 being intermittently engaged with one another. Biasing the mating teeth 46, 50 allows the actuator 30 to advance the carrier 32. As the actuator 30 moves downwardly, the angled portions of the teeth-pairs allow the actuator 30 to slip past the carrier 32. The carrier 32 is held in place within the inner shell 34 by a frictional force greater than the frictional force of the drive teeth 46 slipping past the carrier teeth 50.

The carrier 32 includes a skirt 54 disposed around the outer edge of the carrier 32. The skirt 54 is slightly larger than the surrounding interior wall of the inner shell 34. This creates an interference fit between the carrier 32 and the shell 34 and provides frictional resistance. The skirt 54 is made of an elastic material such as plastic, metal, foam or a composite of materials that allows interference between the skirt 54 and shell 34 to apply a frictional force within a range that balances the forces applied by the actuator 30 including an input force and the biasing force applied by the springs 24. The frictional force holds the carrier 32 in a fixed spatial location relative to the inner shell 34 as the drive teeth 46 slip downwardly past the carrier teeth 50.

Figure 16:
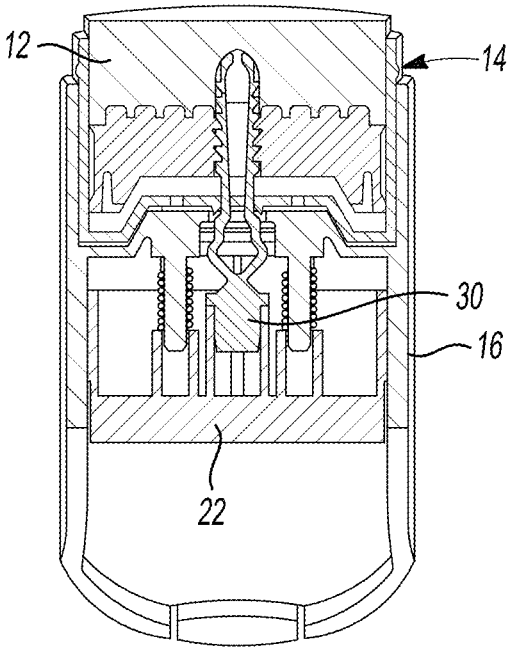
FIG. 16 is a central vertical plane/widthwise cross-section view of the outer package with an assembled reloadable product cartridge in a loaded condition in an initial product advancement configuration.
Figure 21:
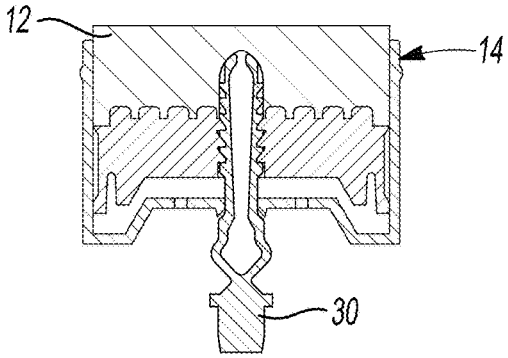

FIGS. 16 and 21 show an initial advancement of the product 12. An upward input force applied to the slider 22 moves the actuator 30 which is connected to the slider 22 upwardly. The springs 24 assembled within the dispenser housing 16 bias the slider 22 and the actuator 30 downwardly when the input force is released.

Figure 17:
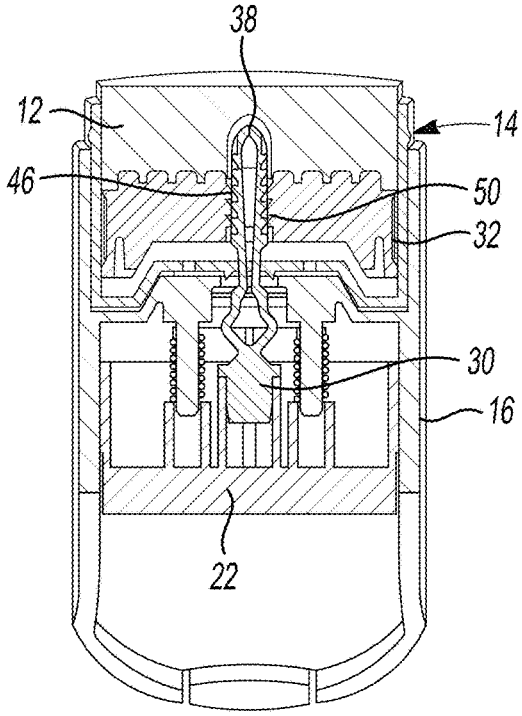
FIG. 17 is a central vertical plane/widthwise cross-section view of the outer package with an assembled reloadable product cartridge in a loaded condition in an intermediate product advancement configuration.
Figure 22:
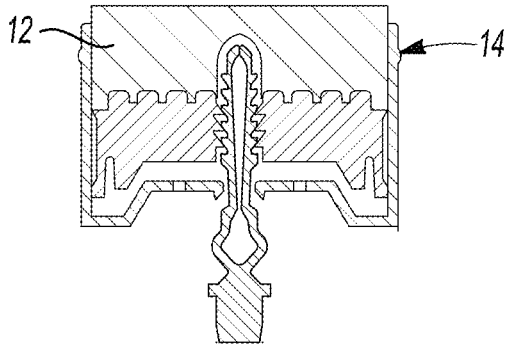
FIGS. 22-25 are central vertical plane/widthwise cross-section views of the advancement and retraction actuator received in the reloadable product cartridge in the process of advancing the product cartridge at an early stage of the product usage.
Figure 38B:
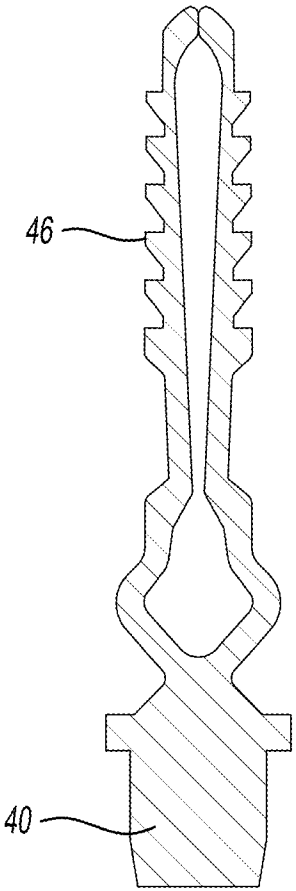
Figure 38A:
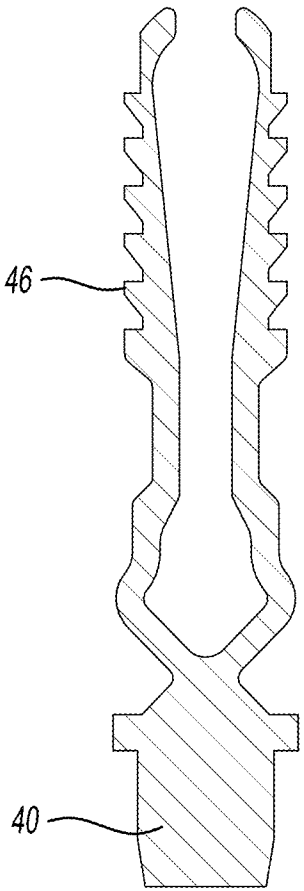
Figure 39:
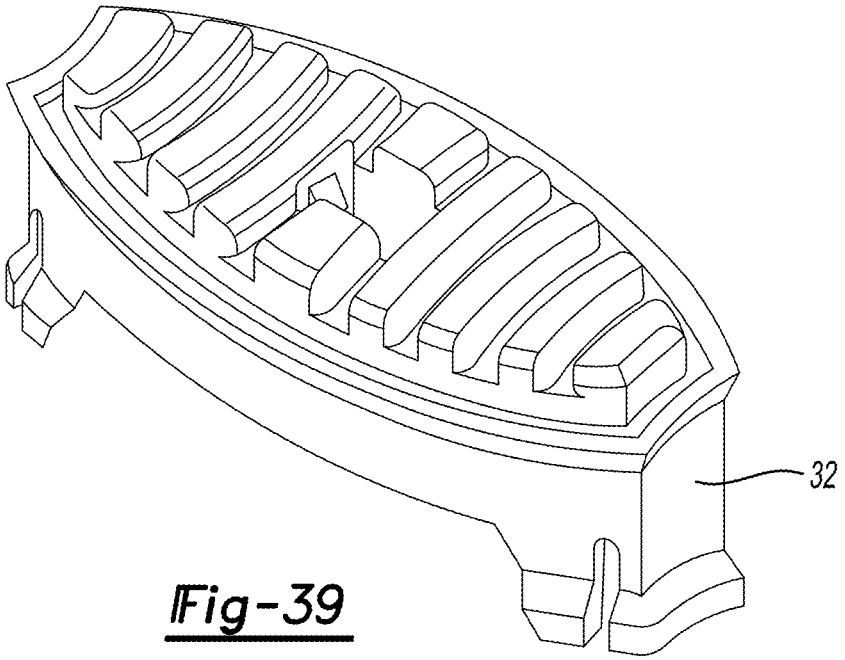
FIG. 39 is a perspective view of the product carrier.
Figure 40:
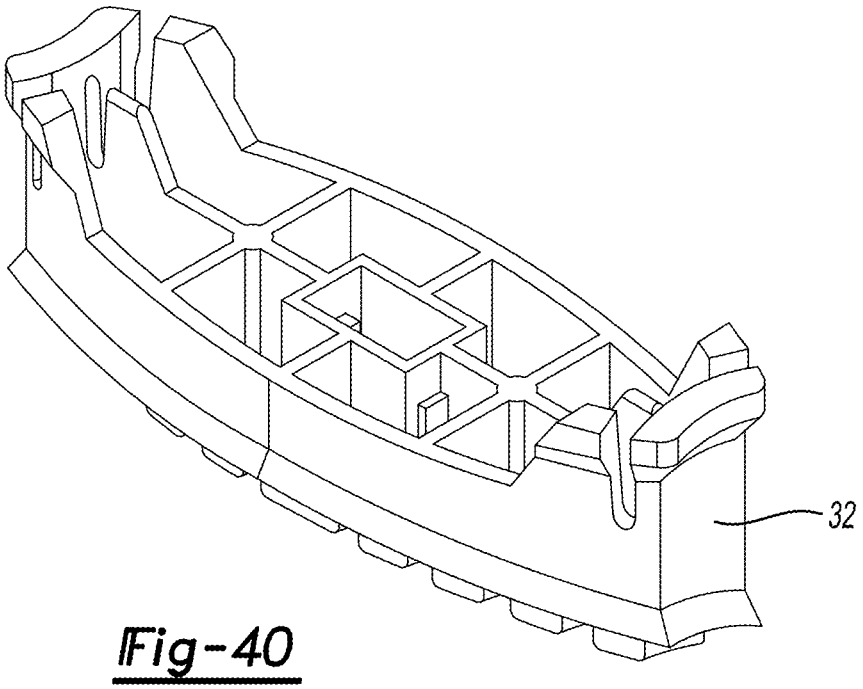
FIG. 40 is an opposite perspective view of FIG. 39 rotated 180° along an axis extending from top-left to bottom-right.

FIGS. 17, 22, and 38B show the drive teeth 46 sliding past the carrier teeth 50. The biasing force applied by the springs 24 returns the slider 22 and the actuator 30 back toward the initial state. The flexibility of the drive arms 38A and 38B allows the drive teeth 46 to slide past the carrier teeth 50. The carrier 32 remains in a fixed location relative to the inner shell by friction.

Figure 18:
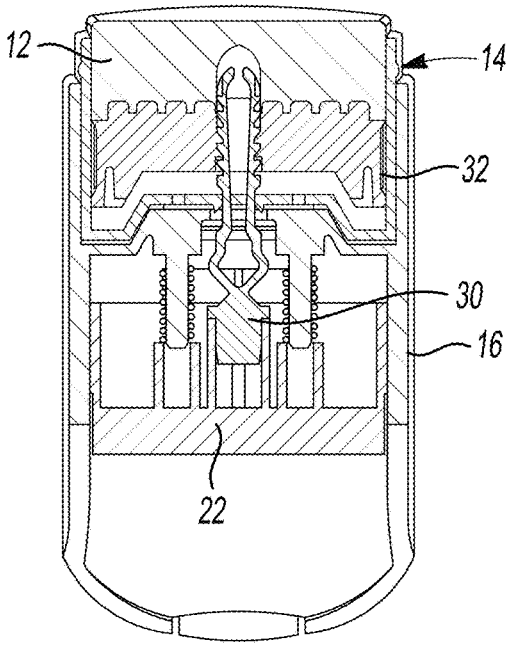
FIG. 18 is a central vertical plane/widthwise cross-section view of the outer package with an assembled reloadable product cartridge in a loaded condition in a final product advancement configuration.
Figure 23:
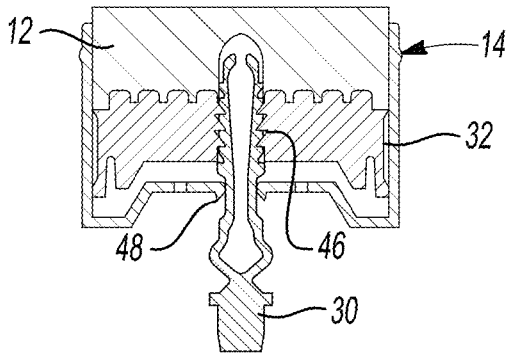
Figure 24:
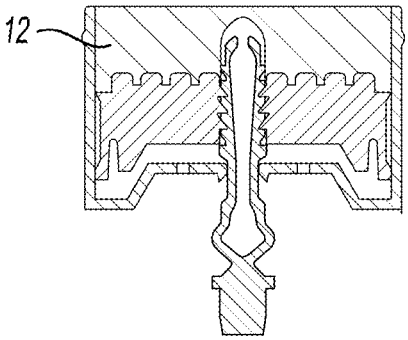
Figure 25:
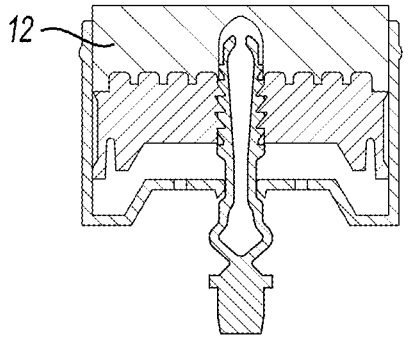
Figure 26:
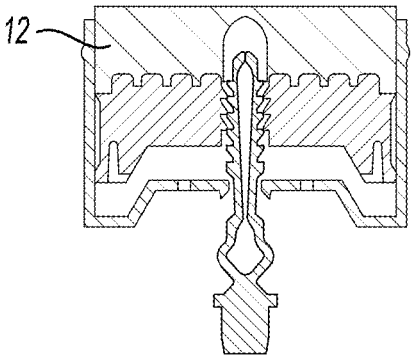
FIGS. 26-31 are central vertical plane/widthwise cross-section views of the advancement and retraction actuator received reloadable product cartridge in the process of advancing the product cartridge at later stages of the product usage.
Figure 27:
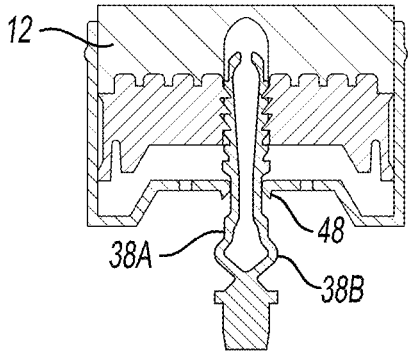

FIGS. 18 and 23 show completed advancement of the product 12. The slider 22 and actuator 30 are in their initial position and the actuator 30 is shown to be returned to the straight configuration of FIG. 38C. The carrier 32 and affixed product 12 are advanced so that a portion of the product 12 is again exposed and may be placed in contact with a surface or sliced off for continued consumption of the product 12.

FIGS. 24 through 27 show another cycle of product advancement like that described above with reference to FIGS. 16 through 23. Another portion of the product 12 has been consumed and the product 12 has been advanced to again expose a portion of the product 12 for continued consumption.

FIGS. 28 through 31 show the product 12 being retracted within the dispenser housing 16. Retraction can be desired if too much of the product 12 has been advanced.

Figure 28:
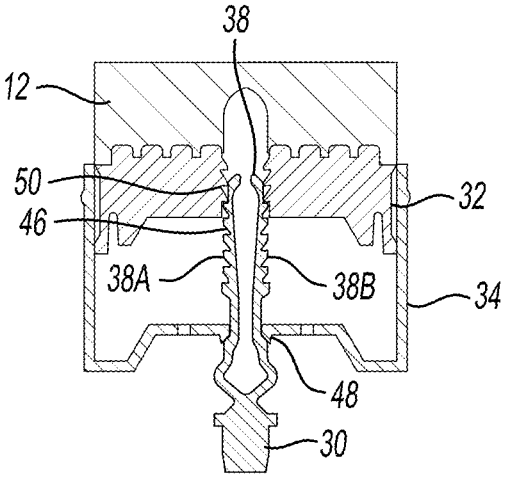
Figure 29:
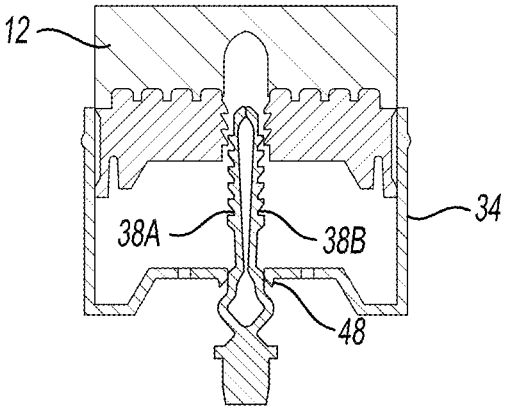
Figure 30:
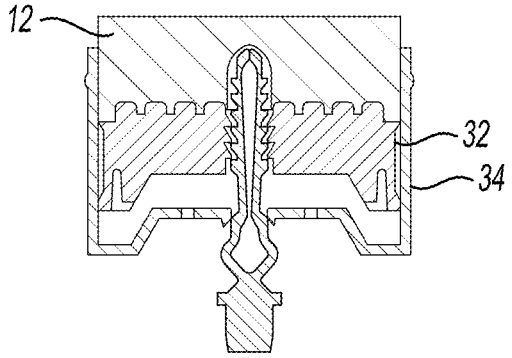
Figure 31:
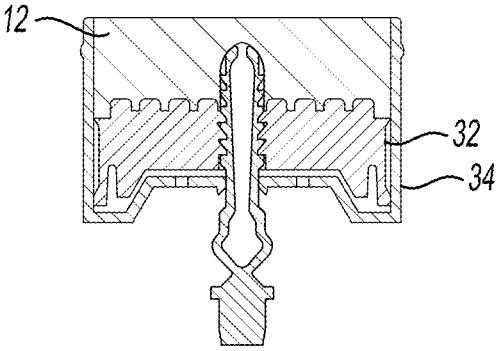

FIG. 28 shows the actuator 30 advanced until the lower outwardly angled portions of the drive arms 38A and 38B are in contact with the shell opening 48. As the actuator 30 is further advanced with additional input force, the angled portions of the drive arms 38A and 38B bias the drive arms 38A and 38B inwardly as shown in FIG. 38B. This allows the drive teeth 46 to disengage the carrier teeth 50. A downward force applied to the product 12 and carrier 32 retracts the product 12 and carrier 32 to a lower position, as shown in FIGS. 30 and 31. It should be noted that this could be done with or without the cap 18 being attached over the top portion of the product 12.

The product cartridge 14 can be removed at any time to replace the fully consumed product cartridge 14 so that the dispenser housing 16 can be provided with accept a new product cartridge 14. A partially consumed product cartridge 14 may be replaced with another product cartridge 14. For example, the product 12 may be made available in different colors or flavors. The product 12 may be made available with products 12 that provide different effects such as calming or energizing effects. The product 12 may also be made available with products 12 that provide different treatments such as treatments for dry hair or oily hair, or different skin conditions such as acne or psoriasis.

Figure 33:
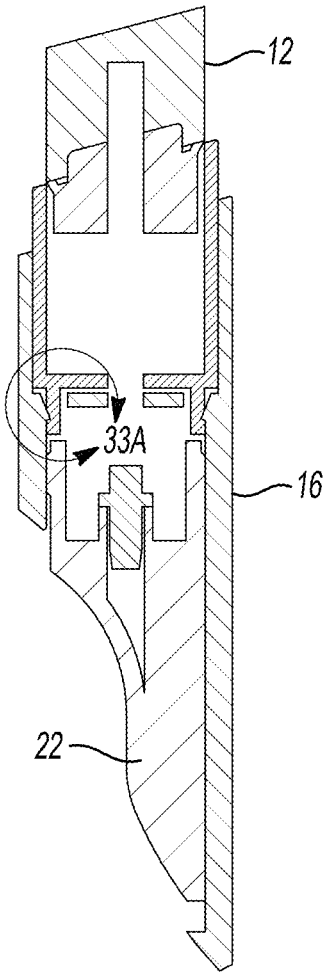
Figure 33A:
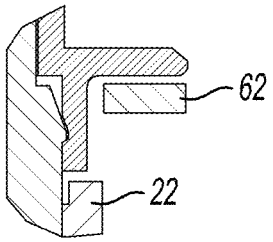
Figure 34:
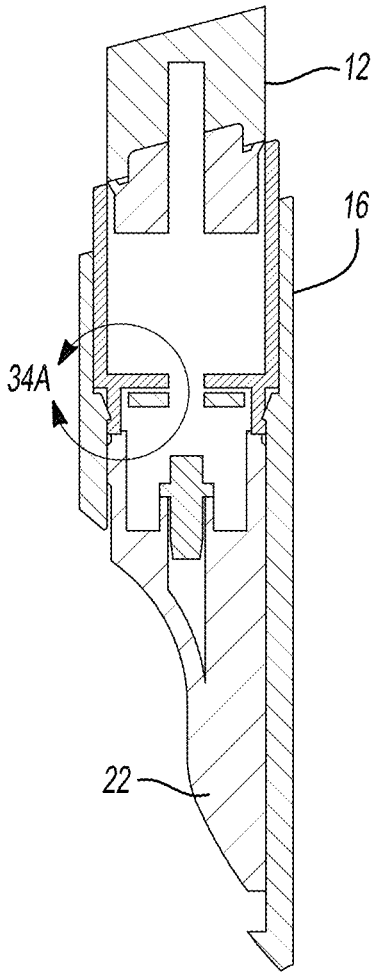
Figure 34A:
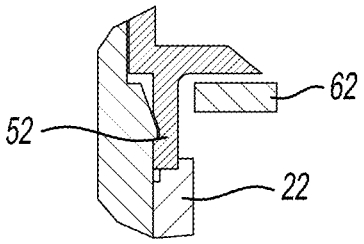
Figure 35:
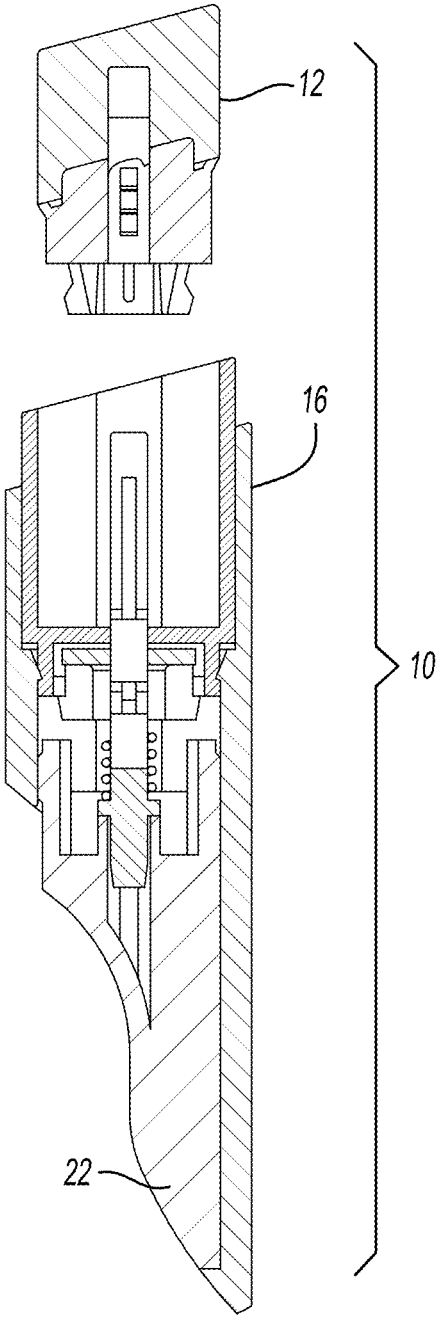
Figure 37B:
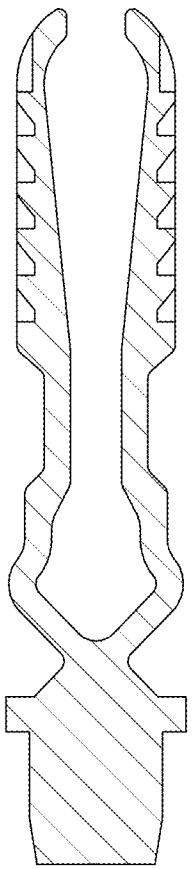
FIG. 37B is a sectional front view of the advancement and retraction actuator.
Figure 37A:
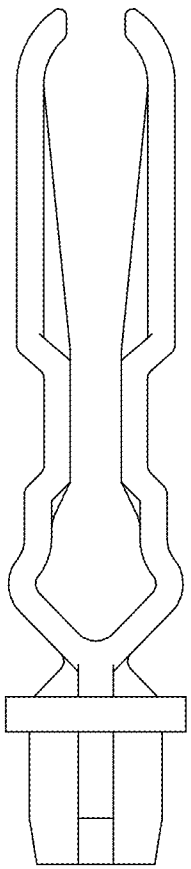
FIG. 37A is front view of the advancement and retraction actuator.

FIGS. 32 through 35 show the product cartridge 14 being removed from the dispenser housing 16. FIG. 32 shows an initial condition. FIG. 32A is a detailed view of a portion of FIG. 32. The inner shell 34 is shown in a latched condition with the dispenser housing 16. The slider 22 is shown below the latch 52. FIGS. 33 and 33A show the slider 22 in an intermediate condition to be closer to the latch than that shown in FIGS. 32 and 32A. FIGS. 34 and 34A show the slider 22 pressing against the latch 52 and applying an upward force to the bottom surface of the latch 52.

The latch 52 is configured with an angled contact area approximately 20° from the horizontal plane. This angle may be in a range of between 0° to 90° depending upon the overall requirements of the system. The upward force applied to the bottom surface of the latch 52 by the slider 22 and the angle of the latch contact area pivots the latch 52 to an unlatched position. The product cartridge 14 is released from the dispenser housing 16 and can now be removed. With the dispenser housing 16 devoid of the product cartridge 14, a new, alternate or the same product cartridge 14 can once again be loaded into the dispenser housing 16 as previously described. It should be noted that this could be done with or without the cap 18 being attached over the top portion of the product 12.

According to one aspect of this disclosure, a dispenser 10 is disclosed for a solid or semi-solid product 12. The dispenser 10 includes an outer shell 20 and a slider 22 disposed inside the outer shell 20. The dispenser 10 also includes an inner shell 34 defining an opening 48 and a carrier 32 adapted to retain the product 12 that is received in the inner shell 34. The carrier 32 includes carrier teeth 50 that are engaged by an actuator 30 connected between the slider 22 and the carrier 32 for advancing the carrier and the product. The actuator includes at least two drive arms 38A and 38B that extend through the inner shell 34 and into the carrier 32. The drive arms 38A and 38B include drive teeth 46 that are adapted to engage the carrier teeth 50.

According to other aspects of this disclosure as it relates to the dispenser 10, the carrier 32 supports the product and may slide relative to the inner shell 34 when the actuator 30 is operated.

The drive arms 38A and 38B of the actuator 30 may be joined together at a base 40 at one end and are spaced from each other as they extend from the base 40 to a distal end, or tips 42 of the arms 38A and 38B. The two drive arms 38A and 38B may be spaced apart and may have outwardly oriented drive teeth 46.

The carrier 32 may define an opening 36 that receives the drive arms 38A and 38B of the actuator 30. The opening 36 may include carrier teeth 50 configured to engage the drive teeth 46 on the drive arms 38A and 38B of the actuator 30. The two drive arms 38A and 38B may be spaced apart and may have outwardly oriented surfaces that include the drive teeth 46. The opening 36 may include the carrier teeth 50 that are configured to engage the drive teeth 46 on the drive arms 38A and 38B of the actuator 30.

The drive arms 38A and 38B may have an expanded position and a compressed position, and the actuator 30 may be engaged to compress the drive arms 38A and 38B together to the compressed position to disengage the drive teeth 46 from the carrier teeth 50 to advance the product 12. The drive arms 38A and 38B may be moved to the expanded position after the product 12 is advanced to hold the carrier 32 stationary until the actuator 30 is subsequently operated.

The dispenser 10 may further comprise at least one spring 24 (two springs 24 are illustrated) disposed between the slider 22 and the inner shell 34 that biases the slider 22 away from the inner shell 34. The spring 24 facilitates returning the slider 22 to a return position after the slider 22 and the actuator 30 advance the carrier 32 and the product 12.

The dispenser 10 may further comprise a cap 18 having an end surface 59 configured to support the dispenser at an angle of between 5 and 20 degrees. The cap 18 defines a cavity 60 that contains the product 12. The product 12 is fully received in the cavity 60 and the carrier 32 is partially received in the cavity 60. The outer shell 20 may include a front wall 20A, and a back wall 20B that extend in one direction and are parallel to each other. The end surface 59 of the cap 18 is oriented at an angle relative to the one direction. When the dispenser 10 is supported on the end surface 59 of the cap 18, the front wall 20A and the back wall 20B of the dispenser 10 are disposed at the same angle relative to the one direction.

The dispenser 10 may further comprise a first latch part 52 provided on the inner shell 32, and a second latch part 56 provided on the slider 22. The first latch part 52 and the second latch part 56 are engaged when the carrier 32 is connected to the slider 22. The latch parts 52 and 56 and are disengaged to facilitate removal of the carrier 32 from the dispenser 10.

The dispenser 10 may further comprise a cap 18 defining a cup like enclosure 62 that is received on the inner shell 34 to enclose the product 12. The carrier 32 may be replaced with a cartridge 14 including a replacement carrier 32 and a replacement product 12. The outer shell 20, inner shell 34, actuator 30, and cap 18 need not be replaced when the replacement cartridge carrier 32 and product 12 are replaced.

According to another aspect of this disclosure, a dispenser system 10 is disclosed for a solid or semi-solid product 12 to be dispensed. The dispenser system 10 comprises an outer shell 20 and a slider 22 received within the outer shell 20. An inner shell 34 has a base wall 64 that defines an opening 66 and is assembled within the outer shell 20. A carrier 32 is disposed within the inner shell 34 with a product 12 to be dispensed being retained on the carrier 32. An actuator 30 extends from slider 22 and through the base wall 64 of the inner shell 34 and into an opening 68 defined by the carrier 32. The actuator 30 has a compressed position and an expanded position. The slider 22 is engaged to move the actuator 30 between the compressed position and the expanded position to advance the carrier 32 and the product 12 from the inner shell 34.

According to other aspects of this disclosure as it relates to a dispenser system 10, the actuator 30 may have outwardly oriented surfaces that include drive teeth 46, and the carrier 32 may define the opening 68 that receives the actuator 30. The opening 68 may include carrier teeth 50 configured to engage the drive teeth 46 on the actuator 30.

The dispenser system 10 may include drive arms 38A and 38B of the actuator 30 that are joined together by a base 40 at one end and are spaced from each other as they extend from the one end at the base 40 to a distal end, or tips 42 of the arms 38A and 38B.

The dispenser system 10 may further comprise at least one spring 24 disposed between the slider 22 and the inner shell 34 that biases the slider 22 away from the inner shell 34, wherein the at least one spring 24 facilitates returning the slider 22 to a return position after the slider 22 and the actuator 30 advance the carrier 34 and the product 12.

The dispenser system 10 may further comprise a cap 18 having an end surface 59 configured to support the dispenser 10. The cap 18 may define a cavity 60 in which the product 12 is fully received, and the carrier 32 is partially received in the cavity 60.

The outer shell 20 includes a front wall 20A, and a back wall 20B that extend in one direction and are parallel to each other. The end surface 59 is oriented at an angle relative to the one direction. When the dispenser 10 is supported on the end surface 59 of the cap 18, the front wall 20A and the back wall 20B of the dispenser 10 are disposed at the same angle between 5 and 20 degrees relative to the one direction.

The carrier 32 may be replaced with a cartridge 14 including a replacement carrier 32 and a replacement product 12.

It should be noted that the above systems and methods could be made with the inner shell 34 being integrated into the dispenser housing 16 for a wholly disposable packaging system 10 that would allow incremental advancement of the product 12 that may be quickly retracted for storage, The system and methods described provide greater flexibility in packaging bulk items, improved marketing of such items, reduced material consumption of packaging, and enhanced aesthetics and brand identity for the manufacturer.

Figure 44:
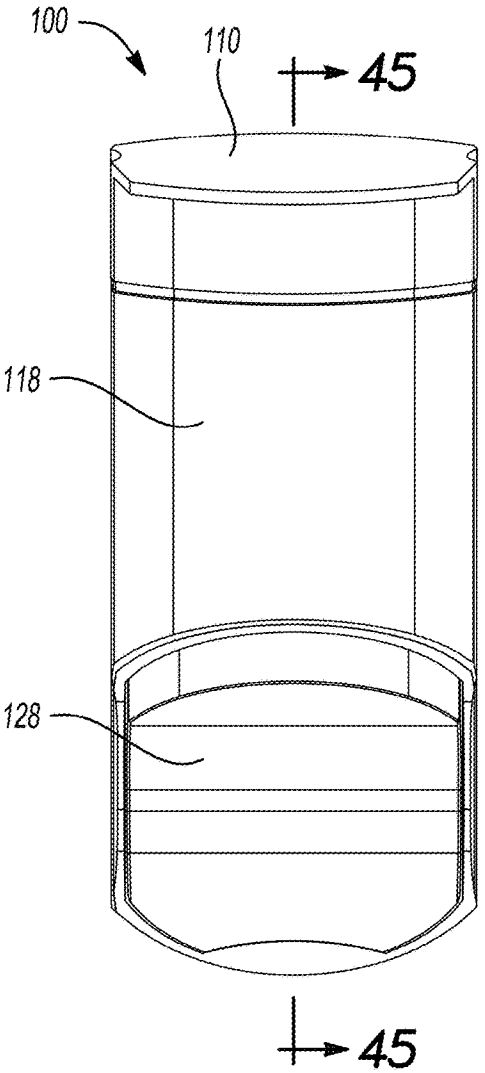
FIG. 44 is a front elevation view of the dispenser shown in FIG. 43.

Referring to FIG. 44, an alternative embodiment of a dispenser 100 for a solid product 102 is illustrated. The dispenser 100 includes a product carrier 104 that contains the solid product 102. A cartridge 106 is adapted to receive the product carrier 104. The product carrier 104 is received in the cartridge 106 that is adapted to be replaced when the solid product 102 is depleted and the solid product 102 is removed with the cartridge 106. A fill cap 108 is assembled to the product carrier 104 to close an opening 109 in the product carrier 104. The opening 109 is provided to facilitate filling the product carrier 104 with the solid product 104 in a liquid form. The solid product 102 is preferably a solid shave product but may well be another type of solid product such as a deodorant, after shave, or other cosmetic product. A lid 110 is removed to provide access to the solid product 102 and is assembled to the dispenser 100 to protect the solid product 102 from damage or evaporation.

Figure 43:
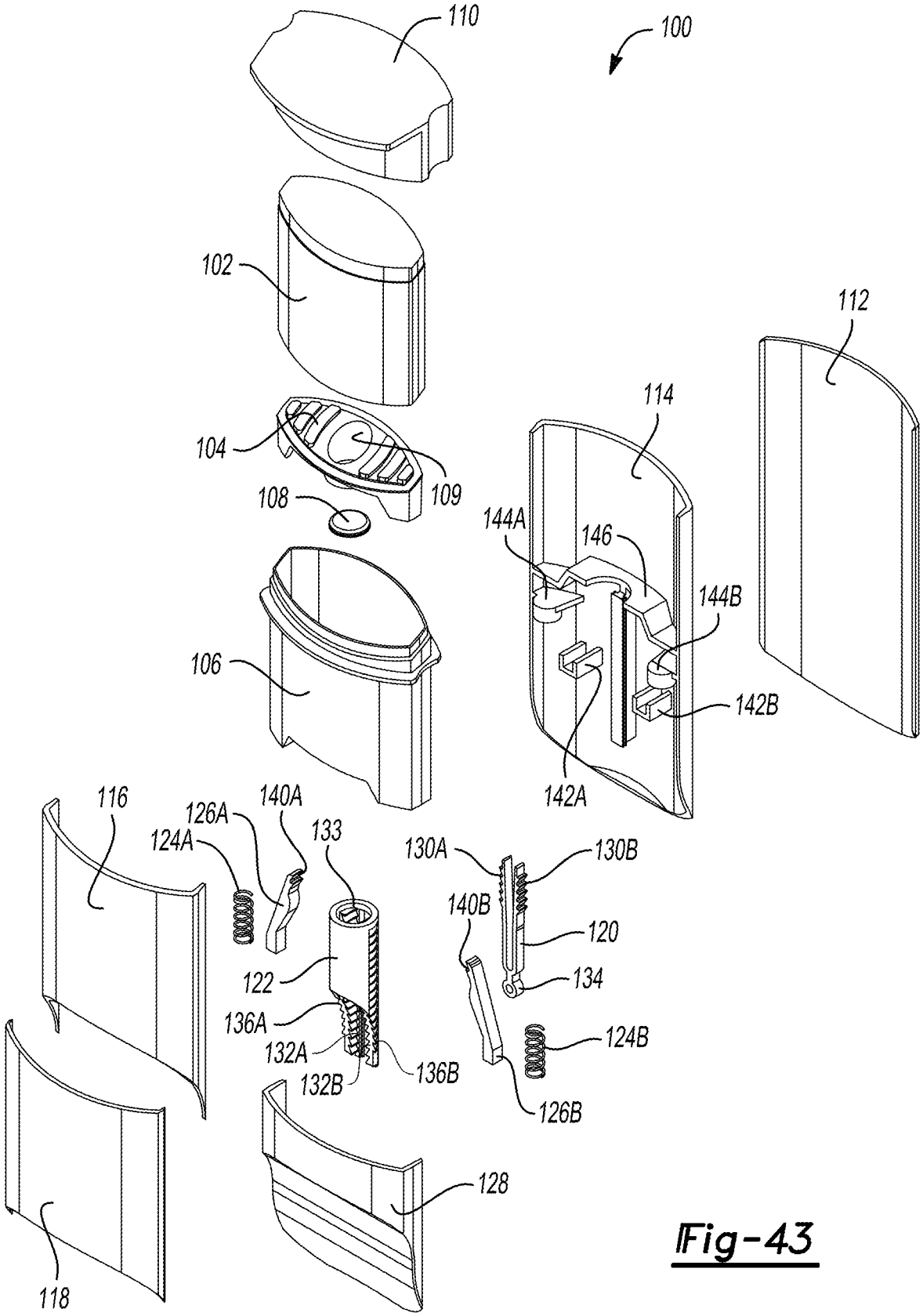
FIG. 43 is an exploded perspective view of an alternative embodiment of a dispenser for solid or semi-solid products.

Referring to FIG. 43, the dispenser 100 includes a front handle 114 and a front cover 112 is assembled to the front handle 114 for aesthetics. The dispenser 100 includes a rear handle 116 and a rear cover 118 assembled to the rear handle 116 for aesthetics.

A pusher fork 120 is assembled to the carrier pusher 122 and to the fill cap 108 or the product carrier 104. The pusher fork 120 is moved with a sliding movement by the carrier pusher 122 to advance the product carrier 104 and the solid product 102. Two return springs 124A and 124 B are adapted to engage two return lock levers 126A and 126B.

A slider 128 is manually engaged to move the pusher fork 120 in a linear direction to slide the product carrier 104 and the solid product 102 relative to the rear handle 116 and the front handle 114. When advancing the product carrier 104 and the solid product 102 the slider 128 is initially moved toward the product 102. The return springs 124A and 124B engage the return lock levers 126A and 126B to bias the slider 128 to move away from the product 102.

Figure 46:
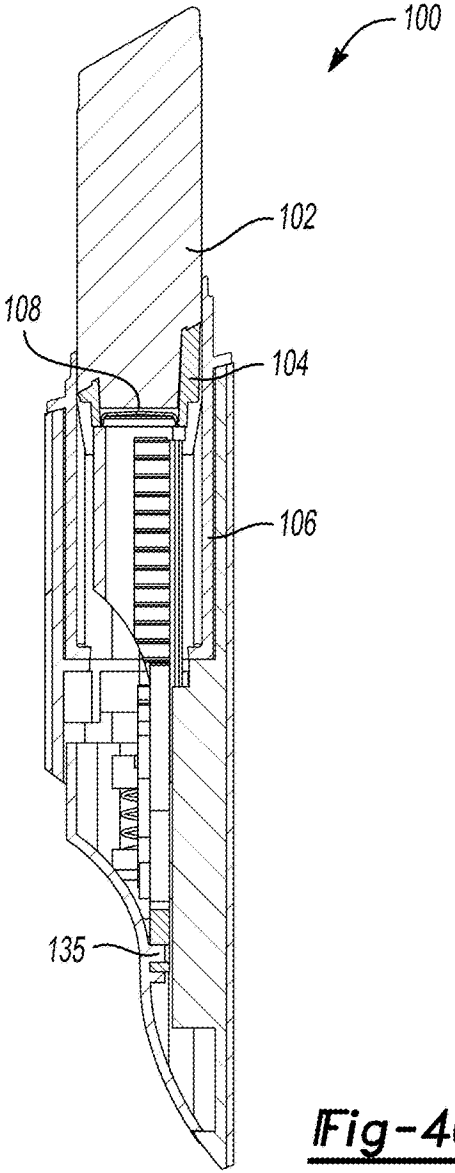
FIG. 46 is a cross-section view taken along the line 45-45 in FIG. 44 showing the dispenser with the product fully advanced.

The pusher fork 120 includes two sets of fork teeth 130A and 130B that engage the carrier locking teeth 132A and 132B, respectively that are located inside the carrier opening 133. The fork teeth 130A and 130B advance the solid product 102 when the slider 128 is actuated. The return lock levers 126A and 126B engage the carrier locking teeth 136A and 136B that are located on an outer surface of the carrier pusher 122. The pusher fork 120 includes a connector 134 that is adapted to connect the pusher fork to the slider 128. The slider 128 includes a pin 135 that is received by the connector 134 as shown in FIGS. 45 and 46.

Carrier locking teeth 136A and 136B are provided on the outer periphery of the carrier pusher 122 that are adapted to be engaged by the return lock levers 126A and 126B. After the product 102 is advanced, the return lock levers 126A and 126B engage the carrier pusher 122 causing the lever teeth 140A and 140B to be received by the carrier locking teeth 136A and 136B. The return lock levers 126A and 126B are attached to lever seats 142A and 142B provided on the front handle 114. The return springs 124A and 124B are assembled to spring retainers 144A and 144B provided on the front handle 114. A cartridge seat 146 is also provided on the front handle 114. The lever seats 142A and 142B, the spring retainers 144A and 144B, and the cartridge seat 146 are formed in a mold that forms the front handle 114.

Figure 45:
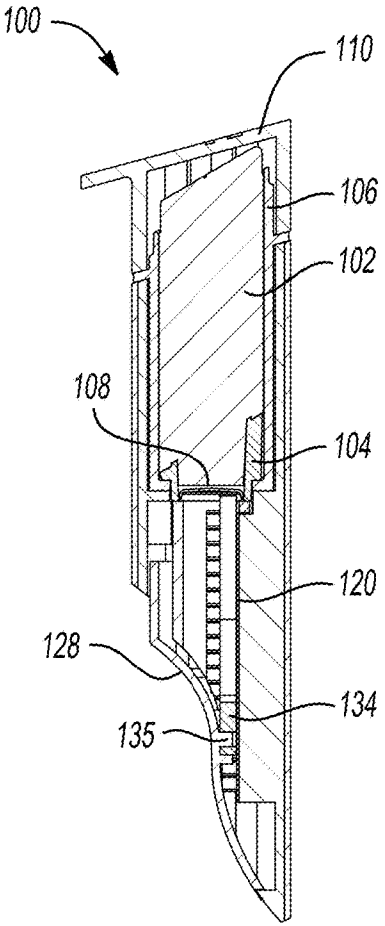
FIG. 45 is a cross-section view taken along the line 45-45 in FIG. 44 showing the dispenser with the product retracted and enclosed by the lid.

Referring to FIG. 44, the dispenser 100 is shown in a back elevation view to include the rear handle 116 and the rear cover 118 that receives the lid 110 on the top end as viewed in FIG. 45. The slider 128 is shown to be disposed in the rear handle 116.

Referring to FIG. 45, the dispenser 100 is shown with the solid product 102 disposed in the product carrier 104 and the cartridge 106 with the lid 110 assembled to the dispenser 100 to enclose the solid product 102. The pusher fork 120 is shown to be attached to the slider with the connector 134 connected to a pin 135 provided on the slider 128. The upper end (as illustrated) of the pusher fork 120 is in engagement with the cartridge 106 and/or the fill cap 108 that is assembled to the product carrier 104.

Referring to FIG. 46, the dispenser 100 is shown with the solid product 102 disposed in the product carrier 104 with the solid product 102 being fully advanced. In the illustrated position, the cartridge 106 and the solid product 102 may be removed and replaced. Different solid products 102 having different characteristics may be interchanged that utilize the same handle. For example, the solid product 102 may be provided with different scents, moisturizers, skin conditioners, medications, supplements, or the like. The solid product 102 may be consumed overtime and require replacement in which case the solid product 102 would be smaller and the top of the solid product would be closer to the cartridge 106.

Examples of several embodiments of the invention are described above, these embodiments do not describe all possible forms of the invention. The words used in the specification are words of description rather than limitation, and it is understood that various changes may be made within the scope of the invention. Features of various embodiments may be combined to form further embodiments of the invention.

What is claimed is:

1. A dispenser for a product comprising:

a handle;

a slider disposed inside the handle;

a cartridge defining a product receptacle;

a carrier adapted to retain the product that is received in the product receptacle;

a carrier pusher connected to the carrier;

an actuator connected between the slider and the carrier pusher, the actuator being configured to advance the carrier pusher, the carrier, and the product, the actuator including a pusher fork that extends from the slider to the carrier pusher, the pusher fork having a first set of teeth that are connected to a second set of teeth provided on the carrier pusher; and a return lock lever connected to a lever seat on the handle, the return lock lever including a lever tooth on a distal end, wherein the carrier pusher has a third set of teeth that are engaged by the lever tooth, and wherein when the slider is advanced the lever tooth is received in one of the third set of teeth to prevent retraction of the carrier pusher.

2. The dispenser of claim 1 wherein the handle includes a front handle portion and a rear handle portion that are assembled together to form the handle.

3. The dispenser of claim 1 further comprising a spring supported by a spring retainer on the handle, wherein the spring extends between the spring retainer and the slider, and wherein the spring exerts a biasing force on the slider, and wherein the spring resists further advancement of the slider.

4. The dispenser of claim 1 wherein the return lock lever is a first return lock lever, wherein a second return lock lever is provided, wherein the first return lock lever is connected to a first lever seat and the second return lock lever is connected to a second lever seat, wherein both lever seats are provided on the handle, and wherein each return lock lever includes at least one lever tooth on a distal end, wherein the carrier pusher has a third set of teeth and a fourth set of teeth, wherein the third set of teeth is engaged by at least one lever tooth of the first return lock lever and the fourth set of teeth is engaged by the at least one lever tooth of the second return lock lever, and wherein after the slider is advanced, the at least one lever tooth of the first return lock lever is received by the third set of teeth and the at least one lever tooth of the second return lock lever is received by the fourth set of teeth to prevent retraction of the carrier pusher.

5. The dispenser of claim 4 further comprising:

a first spring supported by a first spring retainer on the handle, wherein the first spring extends between the first spring retainer and the slider and wherein the first spring exerts a first biasing force on the slider, and wherein the spring resists advancement of the slider; and a second spring supported by a second spring retainer on the handle, wherein the second spring extends between the second spring retainer and the slider; and wherein the second spring exerts a second biasing force on the slider, and wherein the spring resists advancement of the slider.

6. A dispenser for a product comprising:

a handle having a lever seat;

a slider disposed inside the handle;

a cartridge defining a product receptacle;

a carrier adapted to retain the product that is received in the product receptacle;

a carrier pusher connected to the carrier, wherein the carrier pusher has a first set of teeth;

an actuator connected between the slider and the carrier pusher, the actuator being configured to advance the carrier pusher, the carrier, and the product, the actuator including a pusher fork that extends from the slider to the carrier pusher, the pusher fork having a second set of teeth that are connected to a third set of teeth provided on the carrier pusher;

a return lock lever connected to the lever seat, the return lock lever having a lever tooth, wherein the first set of teeth is engaged by the lever tooth; and a lid having an end surface configured to support the dispenser, the lid defining a cavity, wherein the product is partially received in the cavity defined by the lid and is partially received in the cartridge, wherein the handle includes a front portion, and a rear portion that extend in one direction and are parallel to each other, wherein the end surface is oriented at an acute angle relative to the one direction, and wherein when the dispenser is supported on the end surface of the lid, the front portion and the rear portion of the handle are adapted to be disposed at the same acute angle relative to a supporting surface.

7. A dispenser for a non-cylindrical product comprising:

a handle having a lever seat;

a slider disposed inside the handle;

a cartridge defining a product receptacle for the non-cylindrical product;

a carrier adapted to retain the product that is received in the product receptacle;

a carrier pusher connected to the carrier, wherein the carrier pusher has a first set of teeth; and an actuator connected between the slider and the carrier pusher, the actuator being configured to advance the carrier pusher, the carrier, and the product, the actuator including a pusher fork that extends from the slider to the carrier pusher, the pusher fork having a second set of teeth that are connected to a third set of teeth provided on the carrier pusher, a return lock lever connected to the lever seat, the return lock lever having a lever tooth, wherein the first set of teeth are engaged by the lever tooth; and wherein when the product is consumed the cartridge is replaced with a second cartridge including a second product.

8. A dispenser system comprising:

a handle including a lever seat;

a slider received within the handle;

a cartridge assembled within the handle;

a product at least partially contained in the cartridge;

a carrier disposed within the handle;

a carrier pusher connected to the carrier, the carrier pusher having a first set of teeth;

an actuator connected between the slider and the carrier pusher, the actuator being configured to advance the carrier pusher, the carrier, and the product;

a return lock lever connected to the lever seat, the return lock lever having a lever tooth, wherein the first set of teeth are engaged by the lever tooth;

a lid having an end surface that can support the dispenser, the lid defining a cavity, wherein the product is at least partially received in the cavity, and wherein the product is partially received in the cartridge; and wherein the handle includes a front portion, and a rear portion that extend in one direction and are parallel to each other, wherein the end surface of the lid is oriented at an acute angle relative to the one direction, and wherein when the dispenser is supported on the end surface of the lid, the front portion and the rear portion of the dispenser are adapted to be disposed at the same acute angle relative to a supporting surface.

9. The dispenser system of claim 8, wherein the actuator further comprises:

a pusher fork that extends from the slider to the carrier pusher, the pusher fork having a second set of teeth that are connected to a third set of teeth provided on the carrier pusher.

10. The dispenser system of claim 8, wherein the actuator has a compressed position and an expanded position, and wherein the slider is engaged to move the actuator between the compressed position and the expanded position to advance the carrier and the product from the handle.

11. The dispenser system of claim 9 wherein the lid defines a cavity that is received on the cartridge, wherein the cartridge is replaced with a second cartridge including a second product.

12. A solid product dispenser comprising:

a handle;

a product cartridge received by the handle;

a solid product received in the oblong product cartridge;

a carrier contacting the product cartridge; and a slider disposed within the handle, wherein the slider is connected by a pusher fork to a carrier pusher that is connected to the carrier that is in contact with the product cartridge, and wherein the slider is connected to the pusher fork that moves with the slider in an advancement direction to advance the product from the product cartridge, and wherein at least one return lock lever is connected to at least one lever seat on the handle, the at least one return lock lever includes a lever tooth on a distal end, wherein the carrier pusher has a set of carrier locking teeth that are engaged by the lever tooth of the at least one return lock lever, and wherein when the slider is advanced, the lever tooth of the at least one return lock lever is received in one of the set of carrier locking teeth to prevent retraction of the carrier pusher relative to the handle after movement of the slider in the advancement direction.

* * * * *